US005359342A

United States Patent [19]

Nakai et al.

[11] Patent Number: 5,359,342

[45] Date of Patent: Oct. 25, 1994

[54] VIDEO SIGNAL COMPENSATION APPARATUS

[75] Inventors: Seiji Nakai, Osaka; Masashi Kubota, Katano, both of Japan

[73] Assignee: Matsushita Electric Industrial Co., Ltd., Osaka, Japan

[21] Appl. No.: 11,828

[22] Filed: Feb. 1, 1993

Related U.S. Application Data

[63] Continuation of Ser. No. 537,939, Jun. 14, 1990, abandoned.

[30] Foreign Application Priority Data

Jun. 15, 1989 [JP] Japan ..... 1-153391
Jul. 7, 1989 [JP] Japan ..... 1-175854

[51] Int. Cl.[5] ..... G09G 3/36

[52] U.S. Cl. ..... 345/89; 345/147; 345/199

[58] Field of Search ..... 340/703, 721, 767, 782, 340/784, 793, 805, 811, 812; 358/29, 32; 345/147, 87, 89, 199, 112

[56] References Cited

U.S. PATENT DOCUMENTS

| | | | |
|---|---|---|---|
| 4,386,345 | 5/1983 | Narveson et al. | 340/721 |
| 4,766,427 | 8/1988 | Abe et al. | 340/721 |
| 4,801,933 | 1/1989 | Yamamoto et al. | 340/702 |
| 4,825,201 | 4/1989 | Watanabe et al. | 340/765 |
| 4,827,255 | 5/1989 | Ishii | 340/703 |
| 4,897,639 | 1/1990 | Kanayama | 340/812 |

FOREIGN PATENT DOCUMENTS

| | | | |
|---|---|---|---|
| 0190738A2 | 8/1986 | European Pat. Off. . | |
| 0195203A3 | 9/1986 | European Pat. Off. . | |
| 0313331 | 4/1989 | European Pat. Off. | 340/784 |
| 0314084A3 | 5/1989 | European Pat. Off. . | |
| 0303510A3 | 7/1989 | European Pat. Off. . | |
| 2846874A1 | 5/1979 | Fed. Rep. of Germany . | |
| 61-243495 | 10/1986 | Japan . | |
| 62-209418 | 9/1987 | Japan . | |
| 63-37785 | 2/1988 | Japan . | |
| 63-148781 | 6/1988 | Japan . | |
| 2207271 | 1/1989 | United Kingdom | 340/784 |

*Primary Examiner*—Alvin E. Oberley
*Assistant Examiner*—Regina Liang
*Attorney, Agent, or Firm*—Wenderoth, Lind & Ponack

[57] ABSTRACT

In a dot matrix type display represented by a liquid crystal television receiver, as the use of a large screen display screen size progresses, display non-uniformity becomes significant at some screen position attributed to the combination of the property of display panel with the characteristic of the optical system and the like. According to the present invention, by splitting the display screen and converting the video signal by using the different correction data by the split region, display can be performed with composite correction of the display non-uniformity.

9 Claims, 25 Drawing Sheets

FIG. 4(A-1)
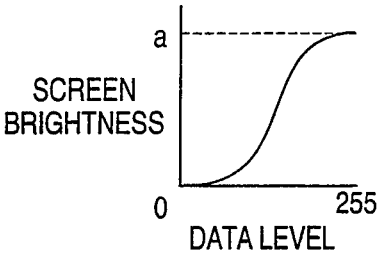
FIG. 4(A-2)
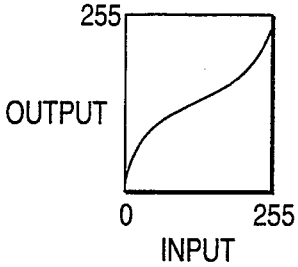
FIG. 4(A-3)
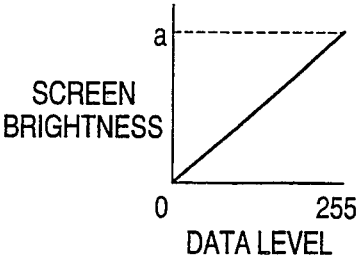
FIG. 4(B-1)
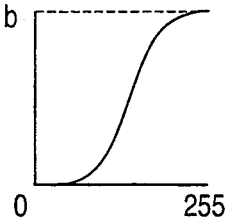
FIG. 4(B-2)
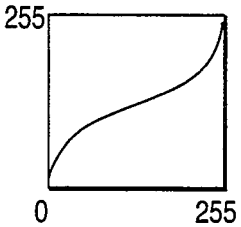
FIG. 4(B-3)
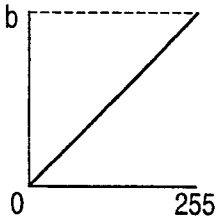
FIG. 4(C-1)
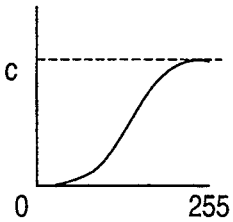
FIG. 4(C-2)
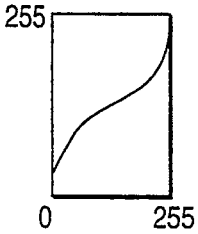
FIG. 4(C-3)
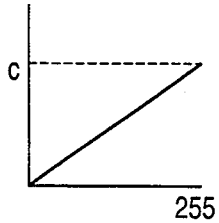

FIG. 5(A-1)
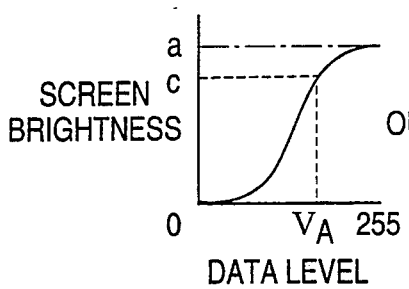
FIG. 5(A-2)
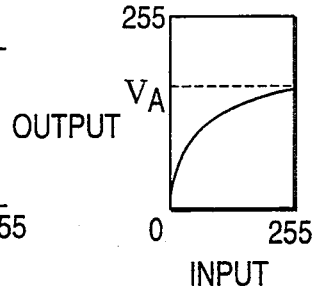
FIG. 5(A-3)
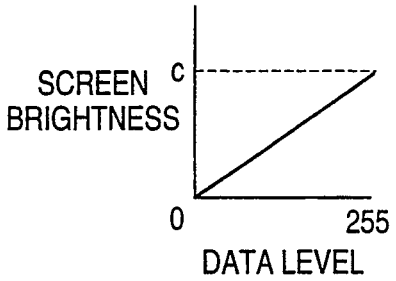
FIG. 5(B-1)
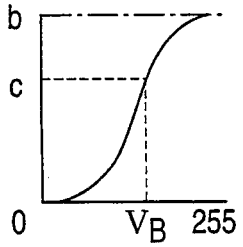
FIG. 5(B-2)
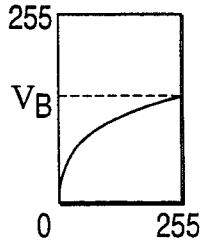
FIG. 5(B-3)
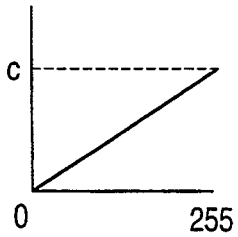
FIG. 5(C-1)
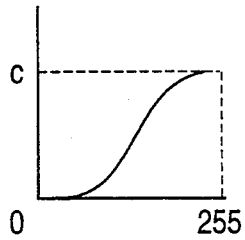
FIG. 5(C-2)
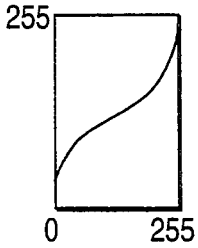
FIG. 5(C-3)
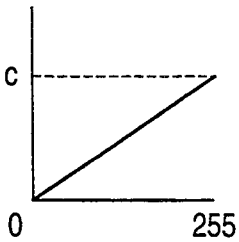

FIG. 9(A-1)
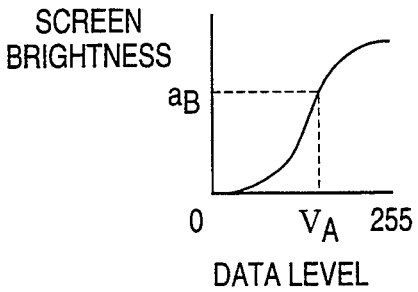
FIG. 9(A-2)
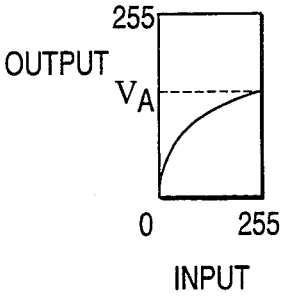
FIG. 9(A-3)
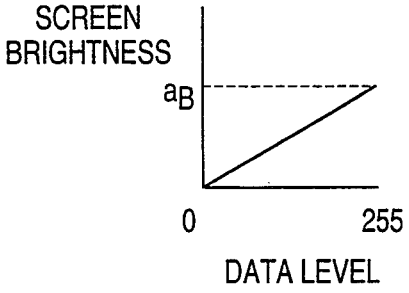
FIG. 9(B-1)
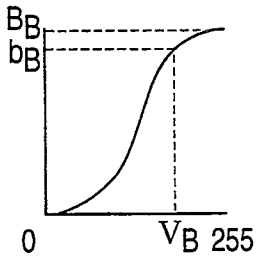
FIG. 9(B-2)
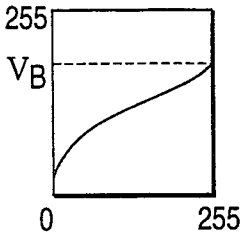
FIG. 9(B-3)
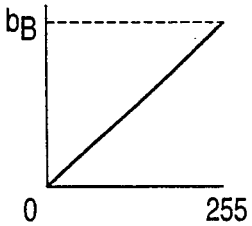
FIG. 9(C-1)
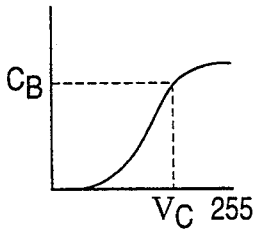
FIG. 9(C-2)
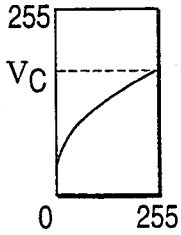
FIG. 9(C-3)
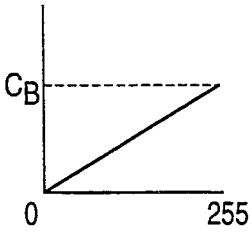

| INPUT | OUTPUT |
|---|---|
| 0 ~ X1-1 | 00 |
| X1 ~ X2-1 | 01 |
| X2 ~ X3-1 | 10 |
| X3 ~ | 11 |

| INPUT | OUTPUT |
|---|---|
| 0 ~ Y1-1 | 00 |
| Y1 ~ Y2-1 | 01 |
| Y2 ~ Y3-1 | 10 |
| Y3 ~ | 11 |

| INPUT | | OUTPUT |
|---|---|---|
| (OUTPUT OF VERTICAL SPLIT POSITION MEMORY 162) | (OUTPUT OF HORIZONTAL SPLIT POSITION MEMORY 161) | (OUTPUT OF BLOCK ADDRESS MEMORY 166) |
| 00 | 00 | 01 |
| 00 | 01 | 01 |
| 00 | 10 | 01 |
| 00 | 11 | 11 |
| 01 | 00 | 01 |
| 01 | 01 | 10 |
| 01 | 10 | 11 |
| 01 | 11 | 11 |
| 10 | 00 | 01 |
| 10 | 01 | 10 |
| 10 | 10 | 11 |
| 10 | 11 | 00 |
| 11 | 00 | 10 |
| 11 | 01 | 10 |
| 11 | 10 | 11 |
| 11 | 11 | 00 |

VIDEO SIGNAL COMPENSATION APPARATUS

This application is a continuation of now abandoned application, Ser. No. 07/537,939, filed on Jun. 14, 1990.

BACKGROUND OF THE INVENTION

1. Field of the Invention

The present invention relates to a video signal compensation apparatus for compensating the video signal inputted to the dot-matrix type display so as to improve display non-uniformity.

2. Description of Prior Art

In conventional video signal compensation apparatuses, a study has been conducted on the display device using a liquid crystal display and the like, and a method of compensation for improving mainly the display characteristics of the liquid crystal panel is specially noted.

For instance, because the input voltage-intensity characteristic of the liquid crystal panel has a non-linear characteristic, when the video signal is directly inputted to the liquid crystal panel, a half-tone display non-uniformity occurs. Accordingly, by providing a look-up-table memory provided with an input/output characteristic which is in a reverse relationship with the input voltage-light transmission characteristic and referring to the memory data thereof, the video signal is converted to carry out compensation of the display non-uniformity. The compensation processings are to be carried out independently by the video signals R, G and B, respectively (e.g. see Japanese Patent Publication KOKAI (Unexamined) No. 62-209478).

With the conventional video signal compensation apparatus of the above type, it is difficult to compensate for the display non-uniformity by the screen position resulting from the recent enlargement in the size of the liquid crystal display. For instance, as the above display non-uniformity, the single panel color filter type display includes the following drawbacks:

(1) Due to the irregularity of liquid crystal elements, the video signal level - screen brightness characteristics at the panel position show differences and non-uniformity occurs in displaying half-tones.

(2) Due to the characteristics such as leakage, even in driving with the same signal, the transmitted light amounts differ between the field starting line and the field ending line, and inclination occurs in the screen brightness distribution.

(3) Owing to the non-uniformity of brightness of the back light (faulty arrangement of fluorescent tube, faulty diffusion of diffusion plate, etc.), the screen brightness become non-uniform.

In the projection display, the following additional drawback is observed:

(4) Owing to the displacement of the optical axis in projecting three colors, non-uniformities of brightness and color occur.

Because of the combination of various display non-uniformities on the screen, the display non-uniformity characteristics at the individual screen positions differ from one another. Accordingly, it has not been possible to perform compensations effective for the whole screen by compensating the video signal by using a look-up-table which has stored only 1 table of data for the whole screen.

SUMMARY OF THE INVENTION

An object of the present invention is to perform an effective compensation to the whole screen by splitting the display screen, converting the video signal by the split region of the screen, and then displaying an image on a screen, in a dot-matrix type display.

In order to attain the above object, the present invention provides a display apparatus comprising a dot matrix type display apparatus for displaying a video signal on a pixel by pixel basis by a dot clock and horizontal and vertical synchronous signals, and a video signal compensation apparatus for compensating the video signal, wherein said video signal compensation apparatus comprises:

a dot counter for counting the dot clock and outputting a first count signal indicative of a horizontal screen position;

a line counter for counting said the horizontal synchronous signal and outputting a second count signal indicative of a vertical screen position;

a screen split control means for producing an output signal according to said first and second count signals which is indicative of a screen split region, said split screen region being one of a plurality of screen split regions; and a correction processing means for correcting an input video signal according to said output signal from said screen split control means and for outputting a corrected video signal to said dot matrix type display apparatus;

and wherein said correction processing means comprises:

an analog-to-digital converter for converting the input video signal to a digital signal;

a look-up-table memory means including therein a plurality of tables each of which has stored therein correction data for a corresponding one of said plurality of screen split regions, said look-up-table memory means being responsive to said output signal from said screen split control means for selecting one of said plurality of tables corresponding to a screen split region indicated by said signals outputted from said screen spit control means and for correcting said digital signal from said analog-to-digital converter according to the correction data stored in the selected screen split region; and a digital-to-analog converter for converting a corrected digital signal outputted from said look-up-table memory means to an analog signal, said analog signal from said digital-to-analog converter being outputted as said corrected video signal from said correction processing means.

By the above construction, it becomes possible to compensation-convert the video signal by screen split region, to correct compositely the display non-uniformity attributed to the properties of the display panel, the characteristics of the optical system, etc., and to obtain uniformity of the whole screen.

BRIEF DESCRIPTION OF THE DRAWINGS:

FIGS. 4(A-1)–4(c-3) are illustrating the compensation and conversion operations in the first embodiment;

FIGS. 5(A-1)–5(c-3) and FIG. 6 are views showing the compensation and conversion operations in the example of changing the compensation data in the first embodiment;

FIGS. 7 through 10 are views showing the compensation and conversion operations in the example of changing the compensation data in the first embodiment;

DESCRIPTION OF THE PREFERRED EMBODIMENTS

Hereinafter, one embodiment of the video signal compensation apparatus of the present invention is described with reference to the drawings.

Figure 1:
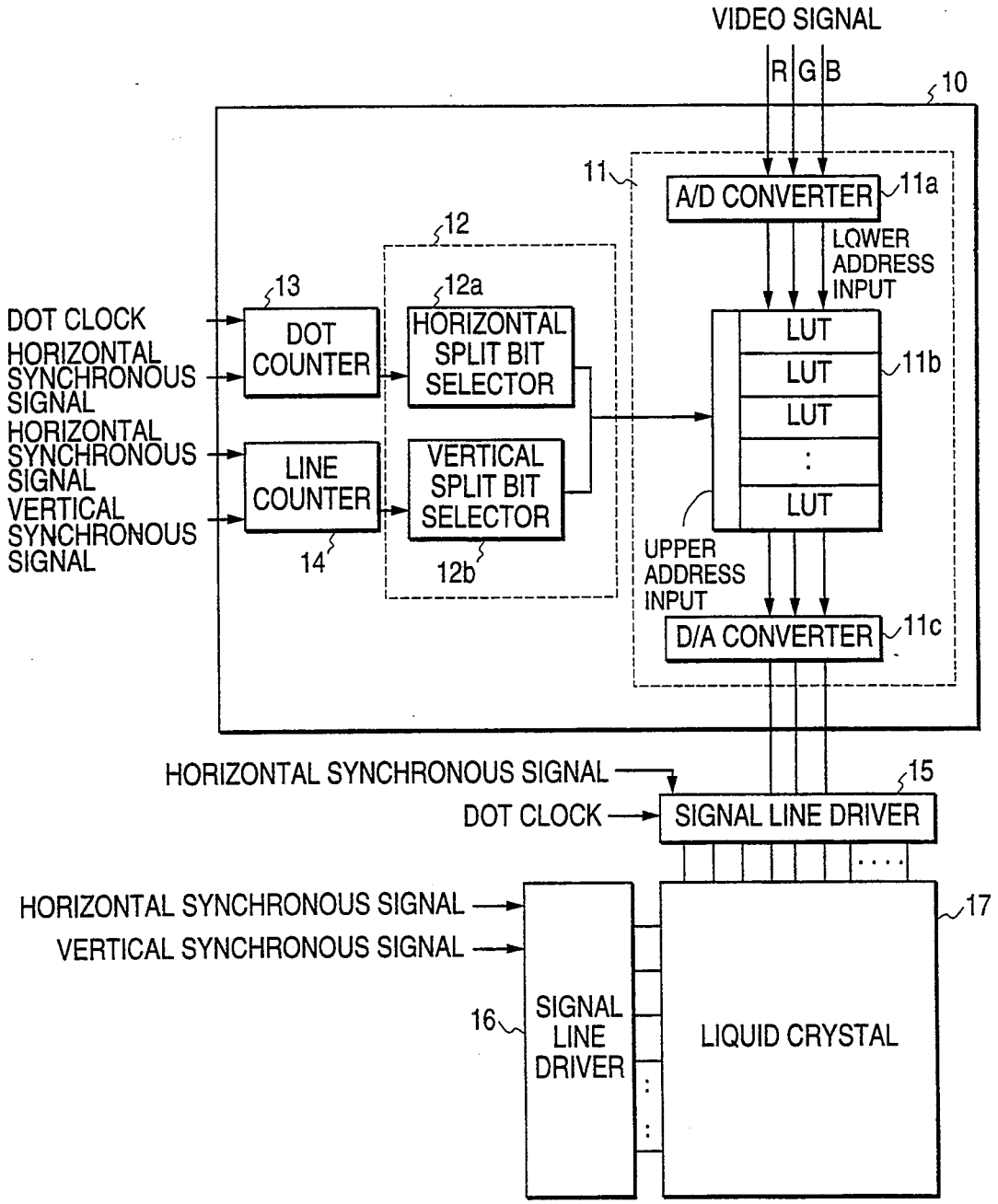
FIG. 1 is a view showing the construction of the liquid crystal display device using the video signal compensation apparatus in accordance with the first embodiment of the present invention.

FIG. 1 shows a construction of the liquid crystal display device using the video signal compensation apparatus in accordance with the first embodiment of the present invention. In FIG. 1, the numeral 10 denotes a video signal compensation apparatus, element 11 is a correction processing means, element 11*a* is an A/D (Analog-Digital) converter, element 11*b* is a look-up-table memory, element 11*c* is a D/A (Digital-Analog) converter, element 12 is a screen split control means, element 12*a* is a horizontal split bit selection circuit, element 12*b* is a vertical split bit selection circuit, element 13 is a dot counter, and element 14 is a line counter.

The video input signals [e.g., three basic color signals of R (red), G (green) and B (blue)] are converted into digital signals by the A/D converter 11*a* and are inputted to the address (e.g., lower address) of the look-up-table memory 11*b*, and are subjected to correction by referring to the table. The corrected video signals are converted to the analog signals by a D/A converter 11*c*. By inputting to the signal line driver 15, they drive the liquid crystal panel for every selected line by the scanning line driver 16. The counter output which has counted the dot clock with the dot counter 13 utilizing the horizontal synchronous signal as a count clear signal is inputted to the horizontal split bit selection circuit 12*a*, and after having been selected to the upper bit of the counter outputs, inputted to the upper address of the look-up-table memory 11*b*. Likewise, the counter output which has counted the horizontal synchronous signal with the line counter 14 utilizing the vertical synchronous signal as a count clear signal is inputted to the vertical split bit selection circuit 12*b*, and after having been selected to the upper bit of the counter outputs, inputted to the address (e.g., upper address) of the look-up-table memory 11*b*. This makes it possible to refer to the look-up-table to the screen split region.

Hereinafter, the operation of the video signal compensation apparatus constituted as above is explained.

Figure 2:
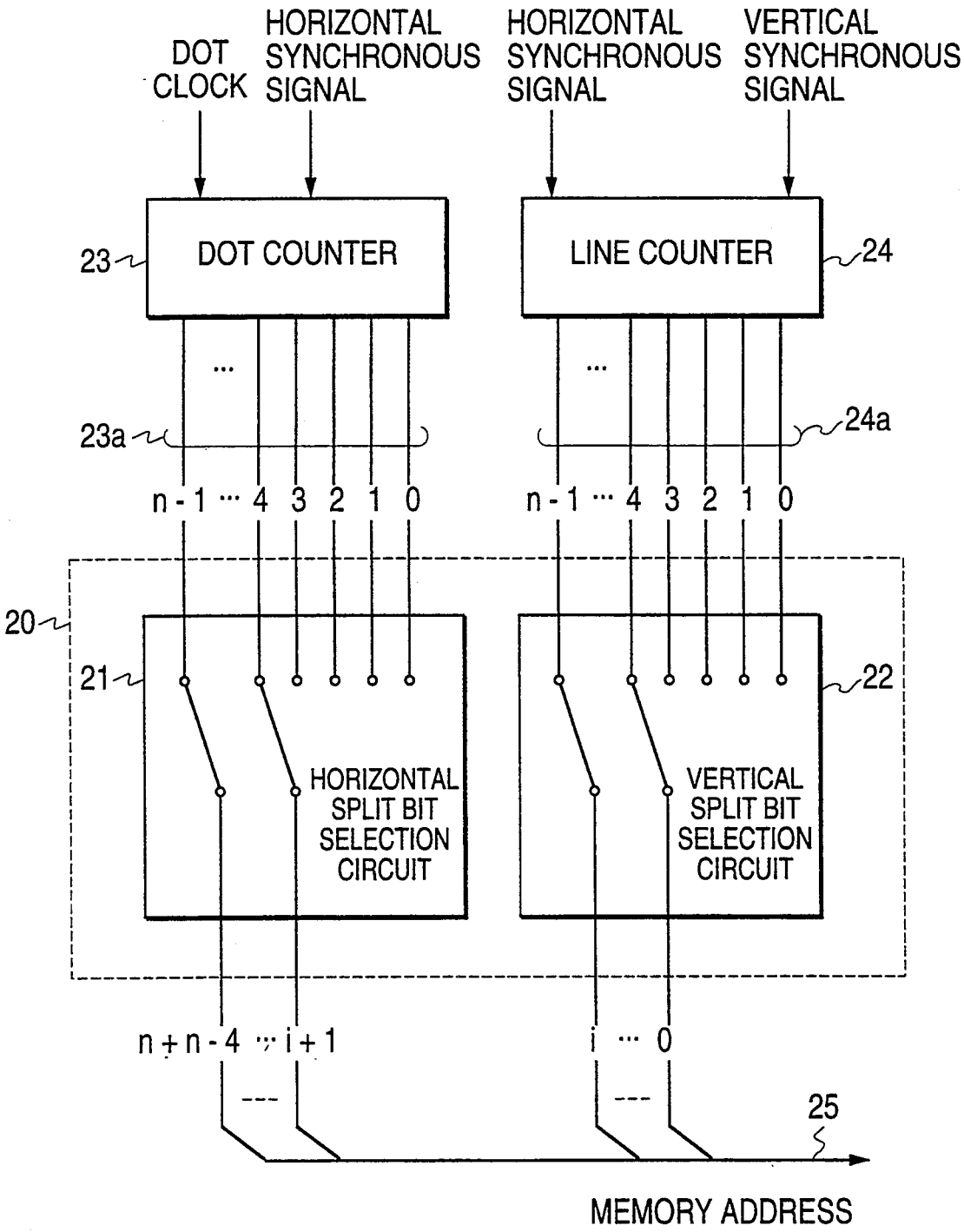
FIG. 2 is a view showing the construction of the screen split control means in the first embodiment.

FIG. 2 shows a construction of the screen split control means 20, which performs connections between the output line 23*a* of the dot counter 23, the output line 24*a* of the line counter 24 and the memory address line 25 of the correction processing means. For example, if the lower 4 bits for both the output line 23*a* and the output line 24*a* are not used when the output line 23*a* has m bit width and the output line 24*a* has n bit width and the memory address line 25 has $m+n-4$ bit width, screen splitting can be performed in 16 dot width in both horizontal and vertical directions.

Figure 3:
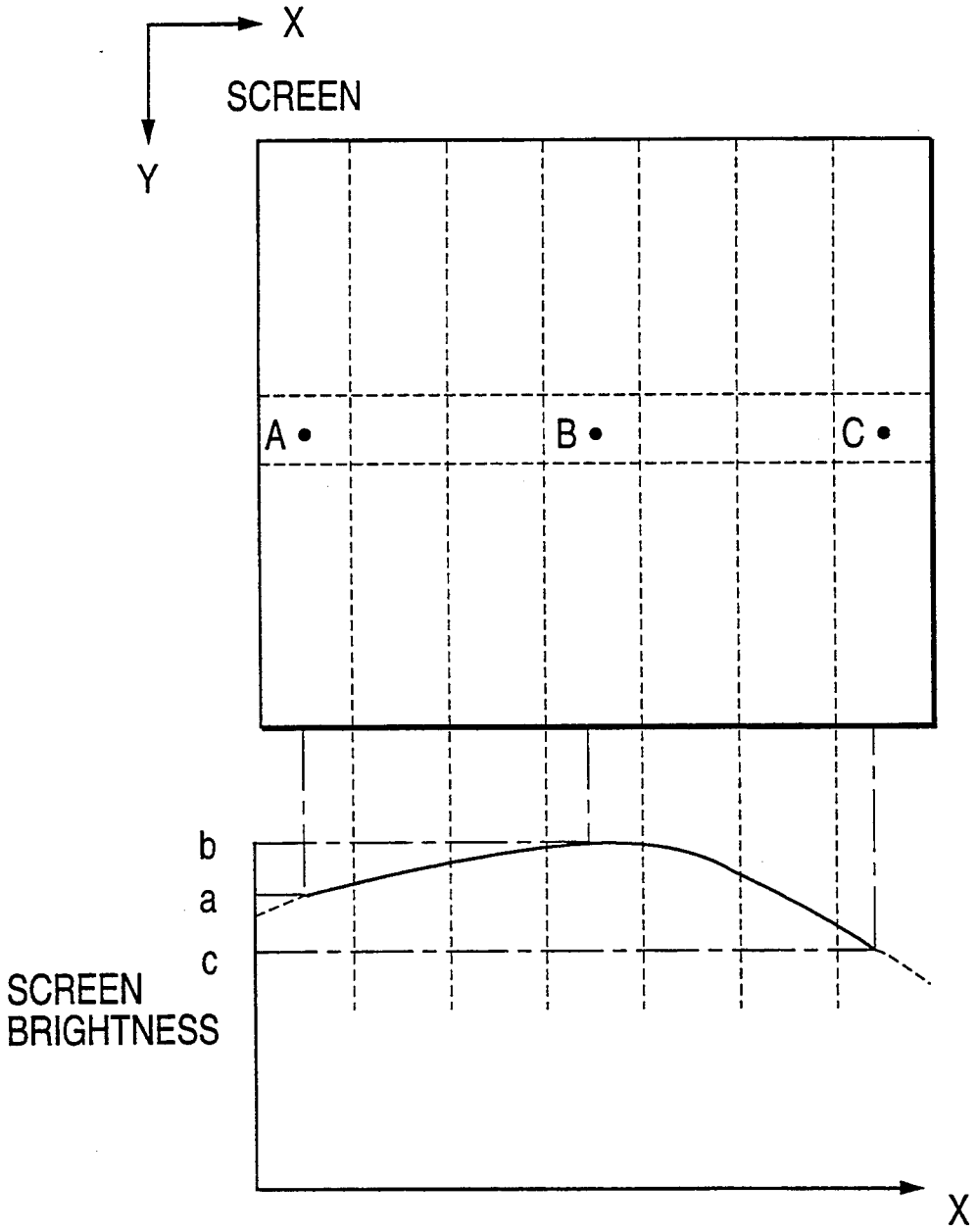
FIG. 3 is a view showing the screen split in the first embodiment.

Assuming, for example, a case where the maximum screen brightness output indicates the levels as shown in FIG. 3 at the measured points A, B and C which denote the representative points of the screen split region, and the respective video signal level - screen brightness characteristics differ as in FIG. 4 (A-1), 4(B-1) and 4(C-1). Assuming the plural correction data (e.g., input and output data having 8 bit width) stored in the look-up-table memory by the screen split region to be the data [shown in FIG. 4 (A-2), 4(B-2) and 4(C-2)] prepared by calculating the inverse curves so that the maximum screen brightness output level such as a, b and c of the characteristic curves at the respective measuring points agree with the dynamic ranges of the input, the video signal level - screen brightness characteristics after the compensation conversion at the respective measuring points become, as shown in FIG. 4 (A-3), 4(B-3) and 4(C-3). In this paragraph an explanation has been provided for a certain color, but the relationships are the same with respect to the other two colors.

Thus, according to this embodiment, even when there exists display non-uniformity on screen, the video signal can be converted by using the correction data for every screen split region, so that there can be obtained an effect which makes it possible to perform a linearity correction effective for the whole screen.

The correction data to be stored in the look-up-table memory can be the data as shown below.

Figure 6:
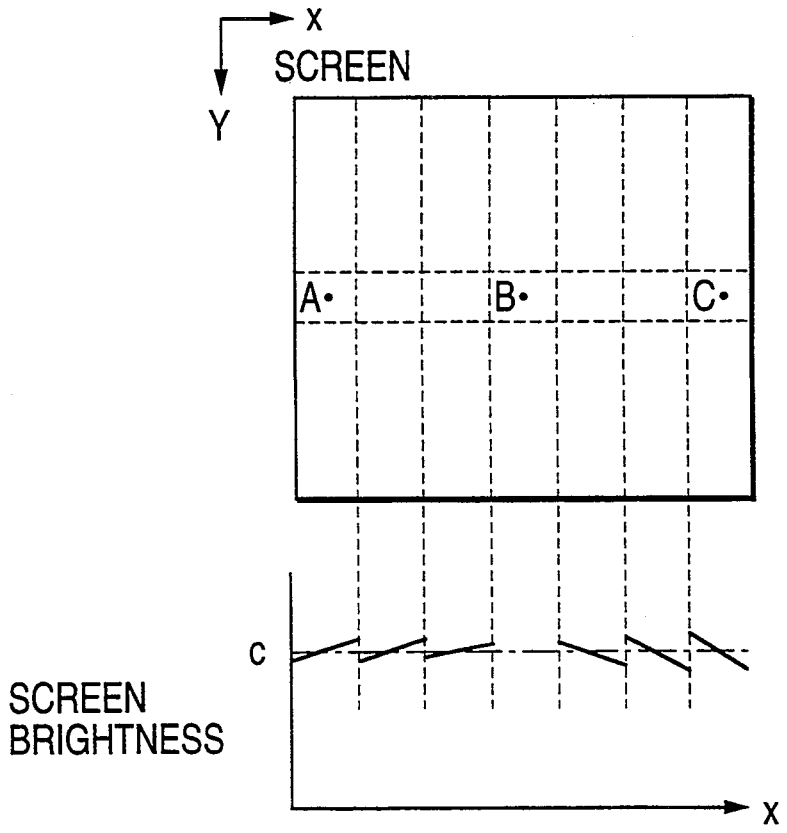

Assuming, for example, the case where the maximum screen brightness output indicates the level similar to that of FIG. 3 at the measuring points A, B and C which show the representative points in the screen split region and the respective video signal level - screen brightness characteristics are as in FIG. 5 (A-1), 5(B-1) and 5(C-1). Since in this case the minimum output level in the maximum screen brightness output level by the screen split area is the value c at the measuring point C, this value c is taken as a normalization level. Assuming the plural correction data (e.g., input and output data having 8 bit width) stored in the look-up-table memory by the screen split region to be the data [shown in FIG. 5 (A-2), 5(B-2) and 5(C-2)] prepared by calculating the inverse curve so that the normalization level c agrees with the dynamic range of the input by using the portion of the screen brightness being from zero level to the normalization level c out of the characteristic curves at the respective measuring points, i.e., the portions surrounded by the discontinued line in FIG. 5 (A-1), 5(B-1) and 5(C-1), the video signal level - screen brightness characteristics after the compensation conversion at the respective measuring points become, as shown in FIG. 5 (A-3), 5(B-3) and 5(C-3). As a result, the maximum screen brightness output becomes an output in conformity with the normalization level c, as shown by the solid line in FIG. 6. In this paragraph an explanation has been provided for a certain color, but the relationships are the same with respect to the other two colors.

Accordingly, when the abovementioned correction data are used, there can be obtained an effect which makes it possible to perform a linearity correction with improvement to the uniformity of the whole screen.

The correction data to be stored in the look-up-table memory can be the data as shown below.

Figure 7:
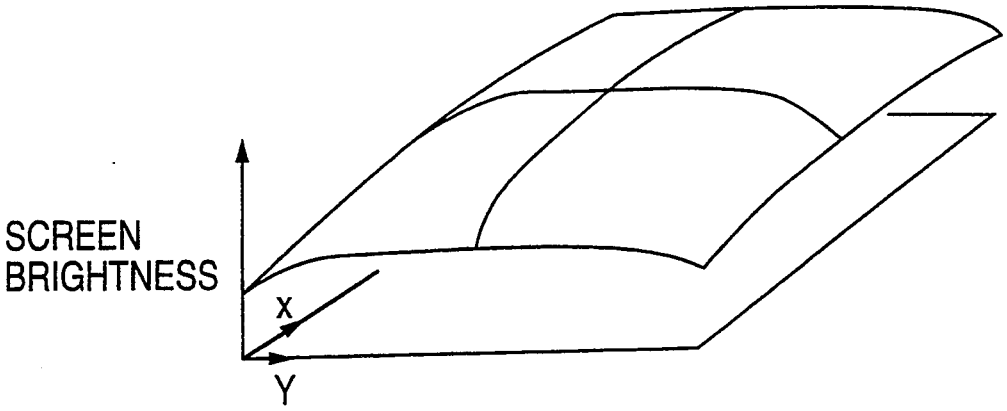
Figure 10:
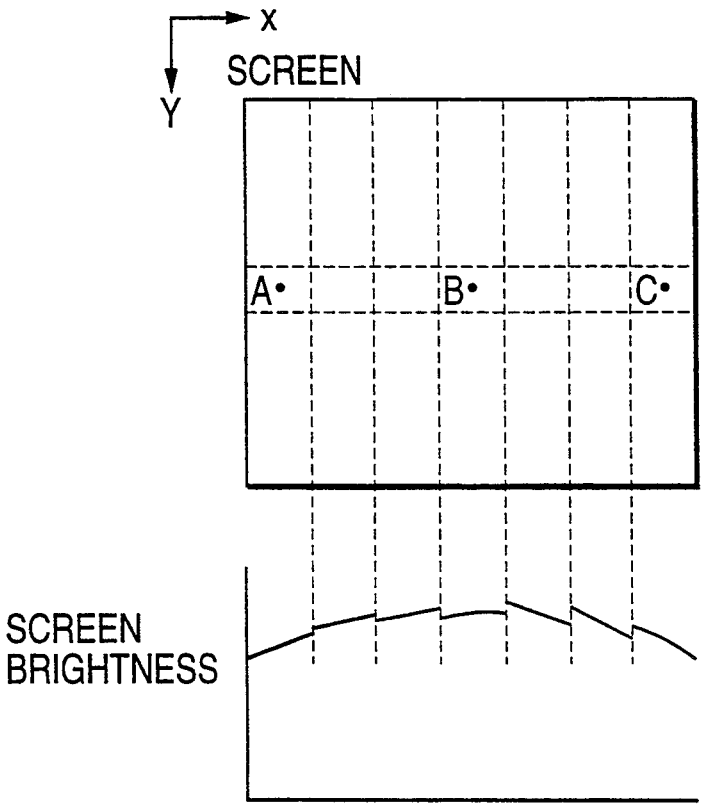
Figure 8A:
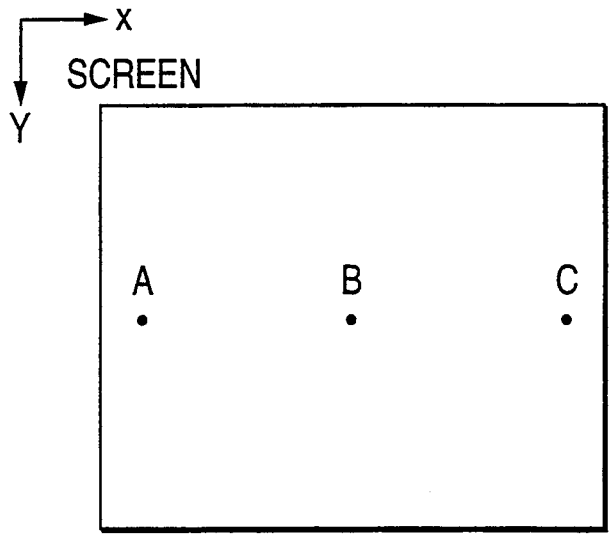
Figure 8B:
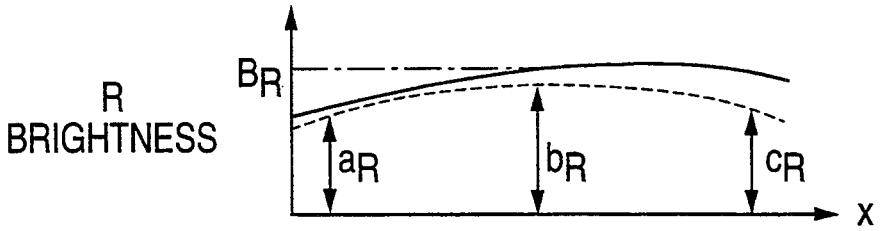
Figure 8C:
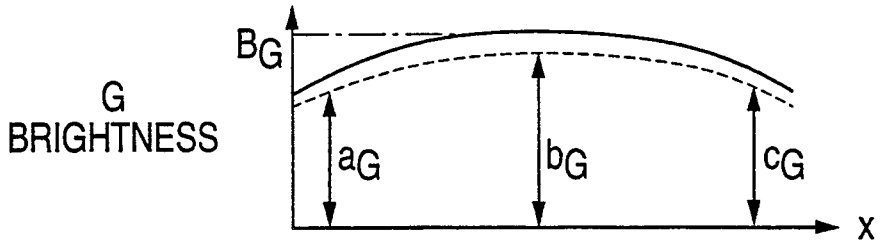
Figure 8D:
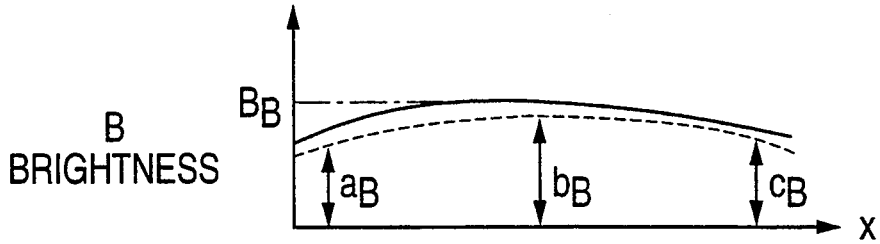

Assuming, for example, to carry out correction so that the maximum screen brightness output indicates the normalization level as shown in FIG. 7, when the maximum screen brightness output is as shown by the solid lines in FIGS. 8B–8D at the measuring points A, B and C shown in FIG. 8A which show the representative points of the screen split region, a normalization level for each color is set out as shown by the dashed line for normalization. At this time, it is necessary to set the normalization level in a ratio (R: G: B) to make the mixed output of the three basic colors, such as $a_R+a_c+a_B$, $b_R+b_G+b_B$ and $c_R+c_G+c_B$, white color. Hereinafter, normalization and inverse conversion of the color B out of the three basic colors are shown. There is assumed a case where the video signal level - screen brightness characteristics at the measured points A, B and C are as in FIG. 9 (A-1), 9(B-1) and 9(C-1). In this case, the normalization levels by screen split area are $a_B$, $b_B$ and $c_B$ at the measuring points A, B and C. Assuming the plural correction data to be stored in the look-up-table memory by screen split area (e.g., input and output data having 8 bit width) to be the data [shown in FIG. 9 (A-2), 9(B-2) and 9(C-2)] prepared by calculating the inverse curve so that the normalization level agrees with the dynamic range of the input by using the portion of the screen brightness being from zero level to the normalization level ($a_B$, $b_B$ and $c_B$) out of the characteristic curves at the respective measuring points, i.e., the portions surrounded by the discontinued line in FIG. 9 (A-1), 9(B-1) and 9(C-1), the video signal level - screen brightness characteristics after the compensation conversion at the respective measuring points become, as shown in FIG. 9 (A-3), 9(B-3) and 9(C-3). As a result, the maximum screen brightness output becomes as shown in FIG. 10. In this paragraph an explanation has been provided for the color B, but the relationships are the same with respect to the other two colors.

Accordingly, when the abovementioned correction data are used, there can be obtained an effect of preventing the deterioration of the screen contrast in performing a linearity correction with improvement to the uniformity of the whole screen.

In the above paragraphs, concrete correction data have been described for the purpose of explaining the present invention. However, it is to be understood that the present invention is not limited to the specific correction data. It is to be noted that all such changes apparent to those skilled in the art are included in the scope of the present invention.

The screen split control means can be of the construction as shown below.

Figure 11:
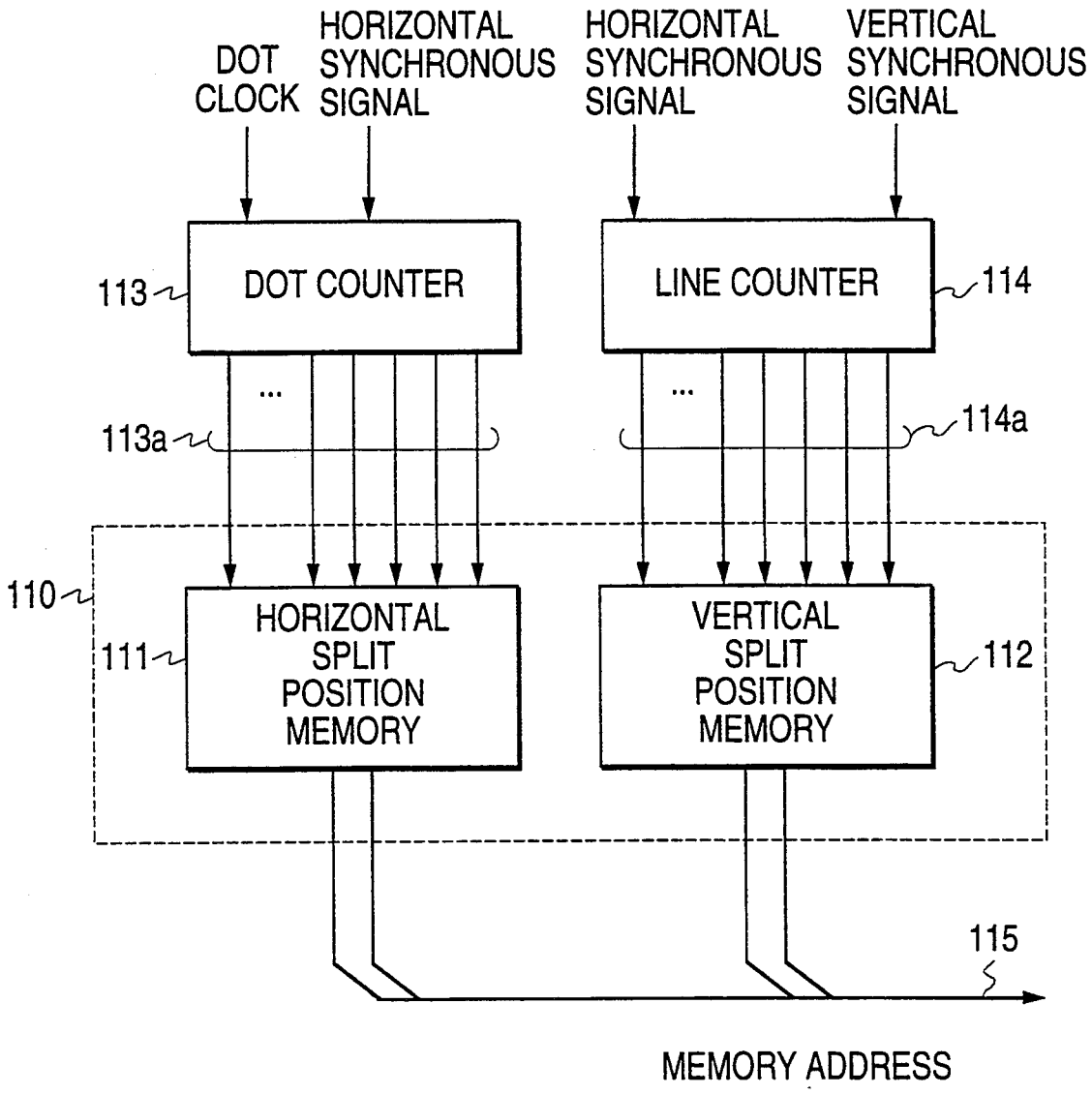
FIG. 11 is a view showing the construction of the screen split control means in the example of changing the screen split control means in the first embodiment.

FIG. 11 shows a construction of the screen split control means 110, which is furnished with a horizontal split position memory 111 for outputting a signal to show the horizontal split position by the count value inputted from the output line 113*a* of the dot counter 113 and a vertical split position memory 112 for outputting a signal to show the vertical split position by the count value inputted from the output line 114*a* of the line counter 114. By inputting the respective output to the memory address line 115 of the correction processing means, the image split width can be optionally set to exercise the video signal compensation by the screen split region.

Figures 12, 13, 14:
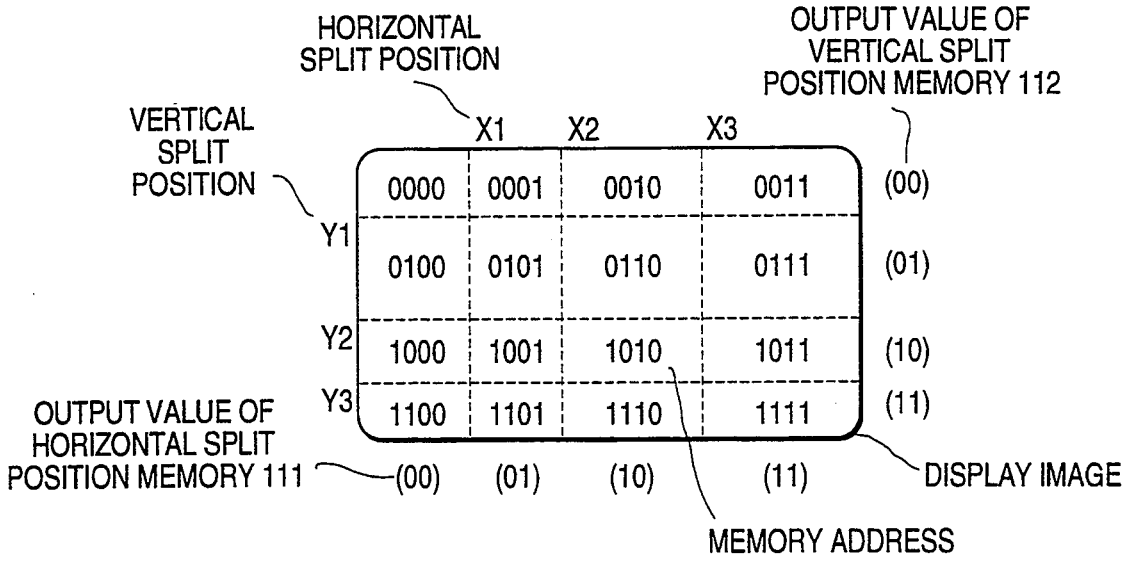
FIGS. 12 through 15(*c*) are views showing the screen split control thereof.
Figure 15C:
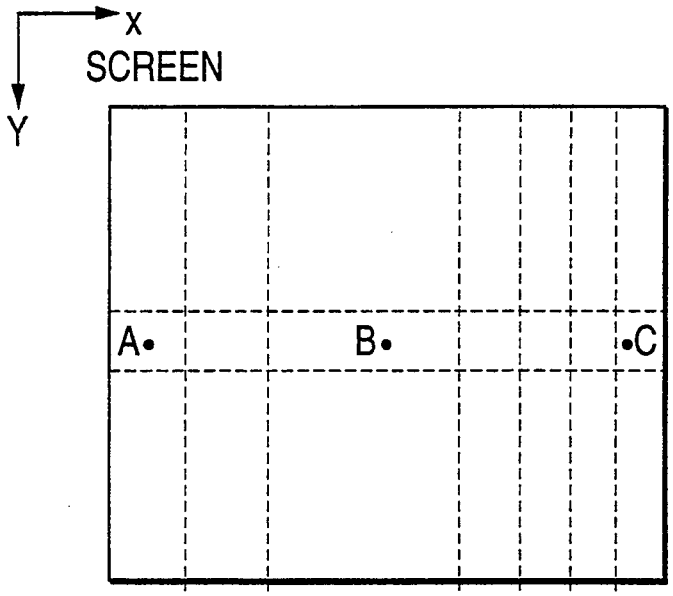
Figure 15A:
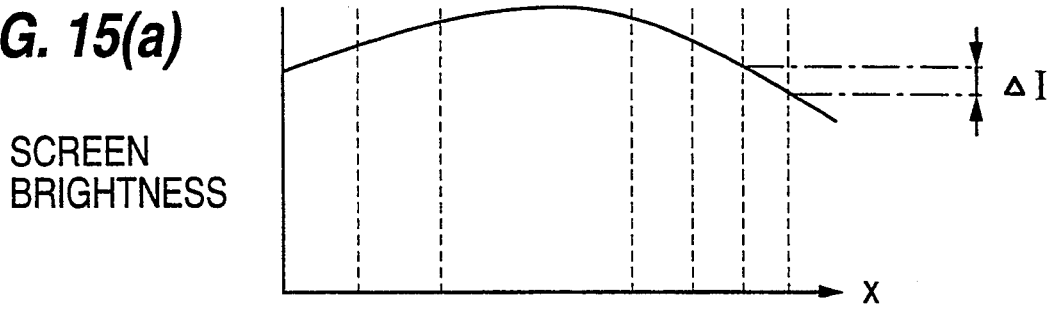
Figure 15B:
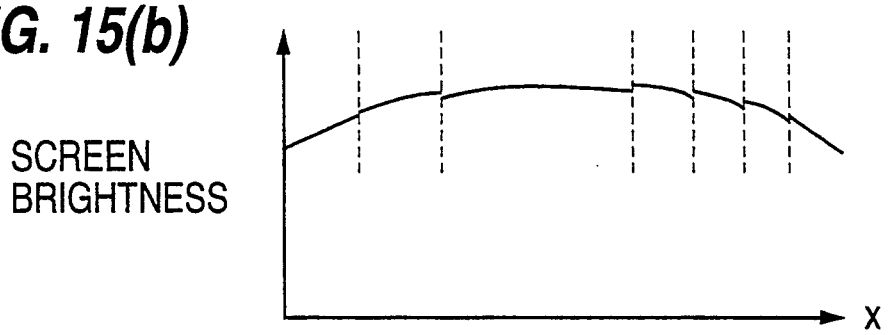

For example, when the display screen is split into 16 blocks (split into four parts horizontally and vertically respectively) as in FIG. 12 and the split positions in horizontal direction are shown in "X1", "X2" and "X3" and the split positions in vertical direction in "Y1", "Y2" and "Y3", the input and output operations of the horizontal split position memory 111 become, as shown in FIG. 13, so as to output "00" when the input from the output line 113*a* of the dot counter 113 is in the range between "0" and "X1−1", and the input and output operations of the vertical split position memory 112 become, as shown in FIG. 14, so as to output "00" when the input from the output line 114*a* of the line counter 114 is in the range between "0" and "Y1−1". Accordingly, as shown in FIG. 15 (*a*), as the screen split can be set by the variation (ΔI) of the maximum screen brightness level, the maximum screen brightness output after the compensation conversion becomes as shown in FIG. 15 (*b*), by which there can be obtained such effects that the difference of brightness in the screen split regions decreases and the difference of color in the case of mixing the three basic colors also decreases among the screen split regions.

Further, the screen split control means may have the construction as shown below.

Figure 16:
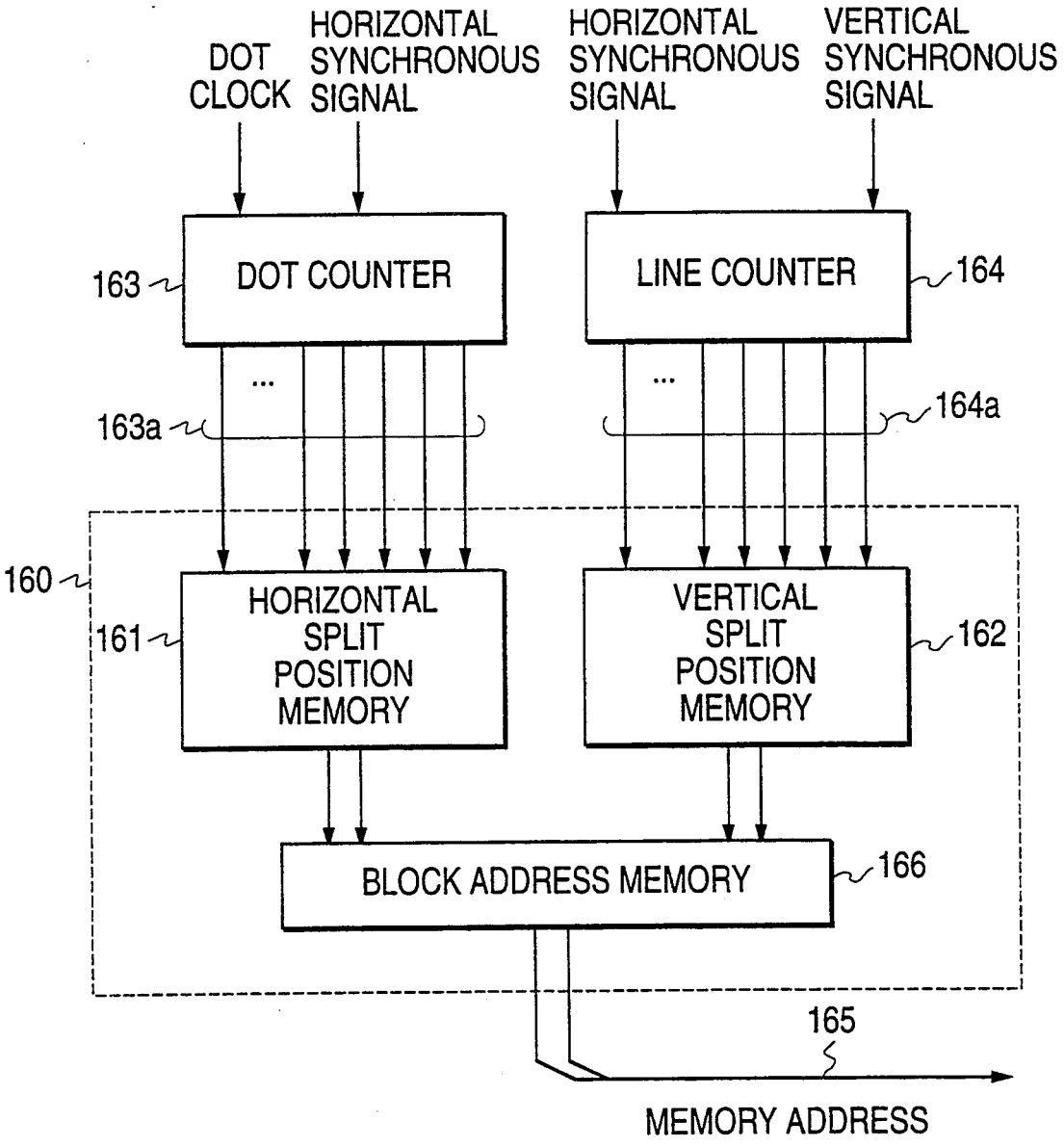
FIG. 16 is a view showing the construction of the screen split control means in the example of changing the screen split control means in the first embodiment.

FIG. 16 shows a construction of the screen split control means 160, which is furnished with a horizontal split position memory 161 for outputting a signal to show the horizontal split position by the count value inputted from the output line 163*a* of the dot counter 163, a vertical split position memory 162 for outputting a signal to show the vertical split position by the count value inputted from the output line 164*a* of the line counter 164, and a block address memory 166 connected to the horizontal split position memory 161 and the vertical split position memory 162 for carrying out correspondence between the screen split region and the memory address. By inputting the output of the block memory address to the memory address line 165 of the correction processing means, the video signal compensation can be performed by the screen split region.

Figures 17, 18:
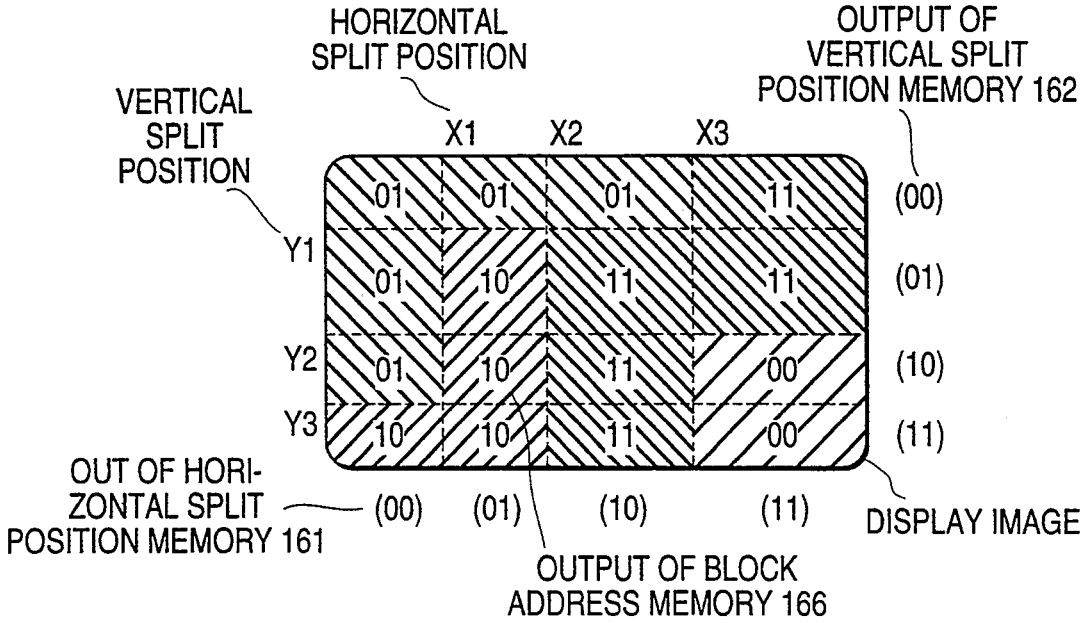
FIGS. 17 and 18 are views showing the screen split control thereof.

For example, when the display screen is split into 16 blocks (split into four parts horizontally and vertically respectively) as in FIG. 12 and the split positions in horizontal direction are shown in "X1", "X2" and "X3" and the split positions in vertical direction in "Y1", "Y2" and "Y3", the output of the horizontal split position memory 161 is 2 bits, which outputs the values of "00" —"11" as shown in FIG. 13, and the output of the vertical split position memory 162 is 2 bits, which outputs the values of "00" —"11" as shown in FIG. 14. With respect to the output of the block address memory 166, when it is set to 2 bit width as shown in FIG. 17, the said 2 bit output is inputted as a memory address of the correction processing means. Accordingly, there can be obtained an effect that, in altering a correction data in a certain screen split region to a correction data in another screen split region, only the content of the block address memory 166 may be altered. In general, as the content of the block address memory 166 is very small in comparison with the correction data amount of the look-up-table memory or the like in the correction processing means, easy and high speed alteration can be realized. Also, by setting the block address memory 166, the same correction data can be used for the different screen split regions. The screen split regions shown by the same hatching in FIG. 18 indicate the case where the compensation conversion were carried out by using the same correction data. In this case, the number of the look-up-table requires a smaller number of screen split regions (e.g., ¼ in FIG. 18), with the result that the size of the look-up-table may be reduced.

In the above paragraphs, concrete screen split control means have been described for the purpose of explaining the present invention. However, it is to be understood that the present invention is not limited to the specific screen split control means. It is to be noted that all such changes apparent to those skilled in the art are included in the scope of the present invention.

Figure 19:
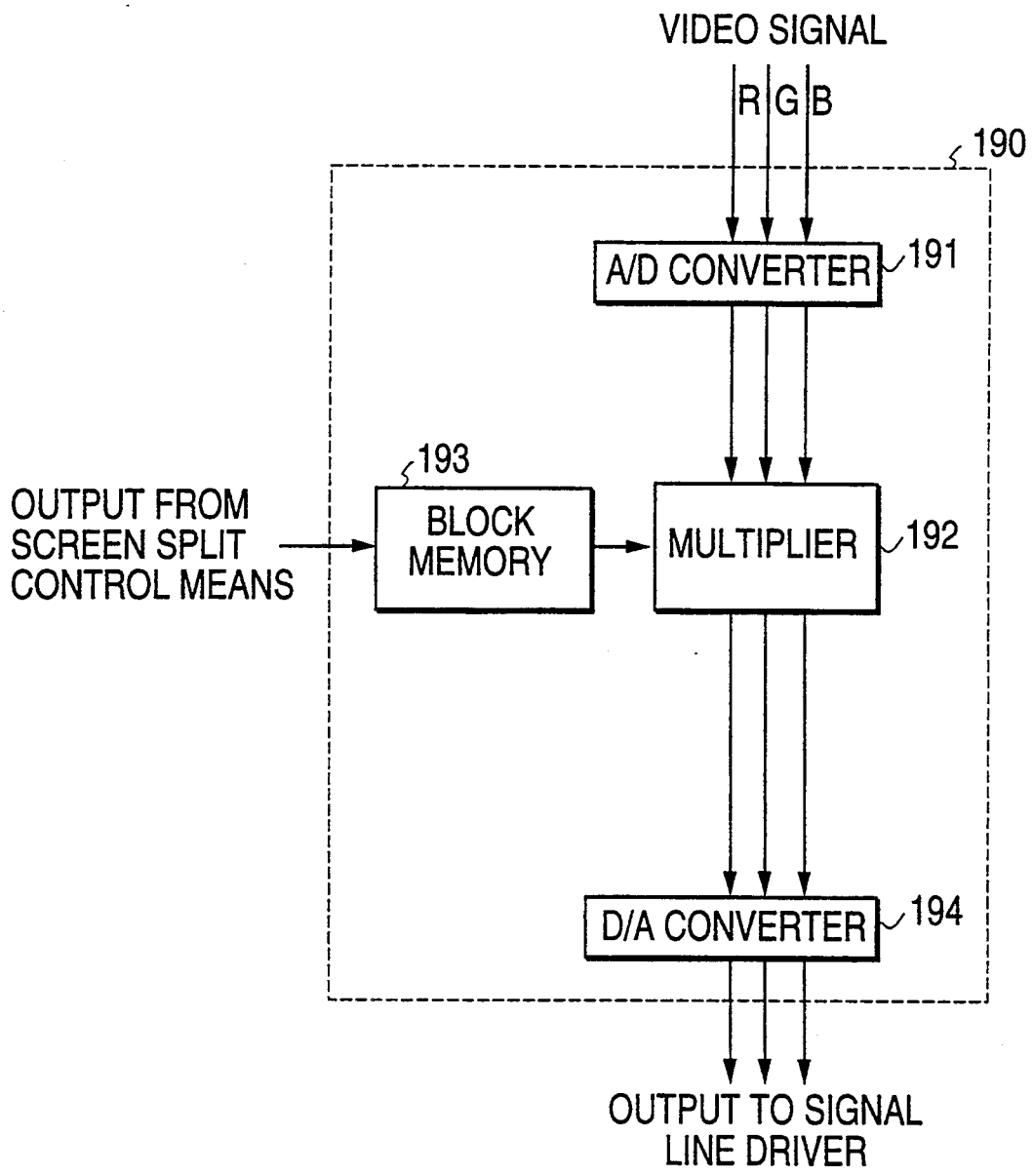
FIG. 19 is a view showing the construction of the correction processing means in the example of changing the correction processing means in the first embodiment.

The correction processing means can be of the following construction;

FIG. 19 shows a construction of the correction processing means 190, in which the video input signals (e.g., the three basic colors R, G and B) are converted to digital signals by the A/D converter 191 and inputted to the multiplier 192, and are subjected to correction by being multiplied with the correction data from the block memory 193. The corrected video signal is converted to analog signal by the D/A converter 194 and then inputted to the signal line driver. Further, in the block memory 193, by correlating the output signal from the screen split control means with the corrected multiplied data by the screen split region, the video signal compensation can be carried out by using the correction data by the screen split region.

Further, as a construction of the correction processing means, an example of storing the corrected addition data by the screen split region in the block memory and converting the video signal by using an adder instead of the multiplier, an example of being provided with a voltage adder for performing addition to the video signal by means of a signal in which the output of the block memory storing the corrected addition data of the video signal by screen split region is subjected to D/A conversion, etc. can be readily analogized.

In the above paragraphs, concrete correction processing means have been described for the purpose of explaining the present invention. However, it is to be understood that the present invention is not limited to the specific correction processing means. It is to be noted that all such changes apparent to those skilled in the art are included in the scope of the present invention.

Figure 20:
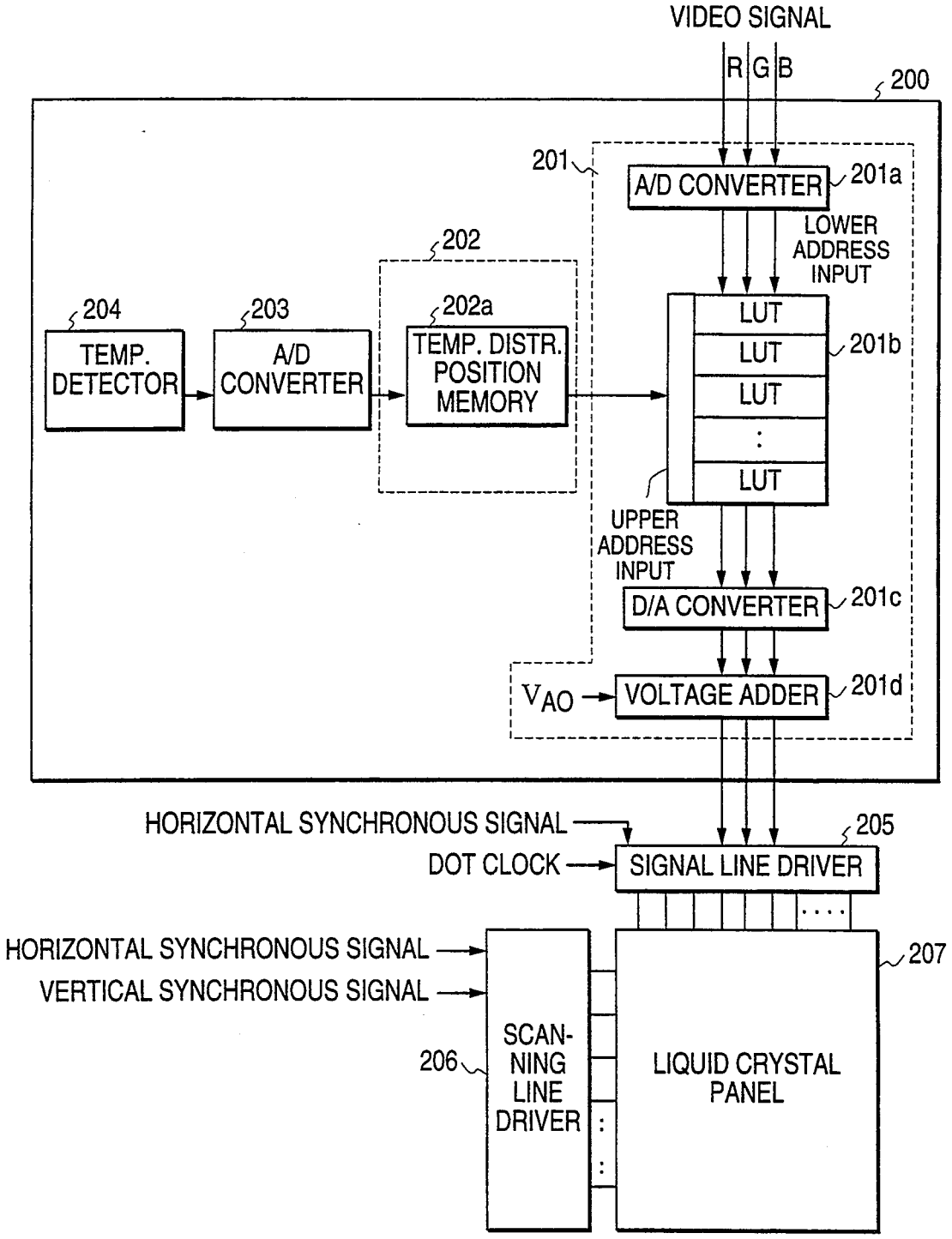
FIG. 20 is a view showing the construction of the liquid crystal display device using the video signal compensation apparatus in accordance with the second embodiment of the present invention.

FIG. 20 shows a construction of the liquid crystal display device using the video signal compensation apparatus in accordance with the second embodiment of the present invention. In FIG. 20, the numeral 200 denotes a video signal compensation apparatus, element 201 is a correction processing means, element 201*a* is an A/D converter, element 201*b* is a look-up-table memory; element 201*c* is a D/A converter, element 201*d* is a voltage adder, element 202 is a temperature control means; element 202*a* is a temperature distribution position memory; element 203 is an A/D converter, and element 204 is a temperature detector.

The video input signals (e.g., three basic color signals of R, G and B) are converted into digital signals by the A/D converter 201*a*, after which they are inputted to the address (e.g., lower address) of the look-up-table memory 201*b* and subjected to correction by referring to the table. The corrected video signals are converted to analog signals by the D/A converter 201*c*, after which an offset voltage by the voltage is added thereto 241, the added adder offset voltage $V_{AO}$ being in agreement with the threshold voltage which shows the rising position of the video signal level - screen brightness characteristic by the voltage adder 201*d*. Thereafter, the video signals are inputted to the signal line driver 205, on which they drive the liquid crystal panel 207 by the selected line by the scanning line driver 206.

Further, at this time, the temperature data obtained by converting the results obtained by measuring the temperature of the liquid crystal panel with the temperature detector 204 into a digital signal by the A/D converter 203 is inputted to the address (e.g., the upper address) input of the look-up-table memory 201*b* as its table number output after referring to the temperature distribution position memory 202*a*. By storing the data for correlating the temperature level with the table number corresponding to the temperature distribution position in the temperature position memory 202*a*, it becomes possible to refer to the look-up-table for the temperature level.

With respect to the video signal compensation apparatus constituted as above, the operation thereof is described below.

Figure 21A:
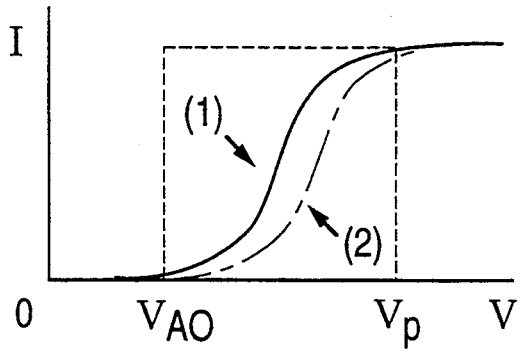
FIG. 21(*a*)–21(*c*) are views showing the operation of the compensation and conversion in the second embodiment.
Figure 21B:
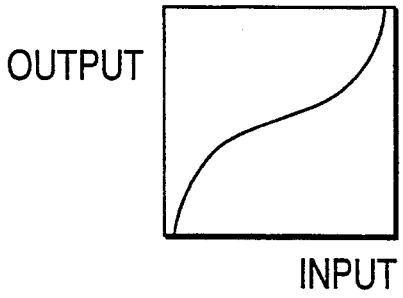
Figure 21C:
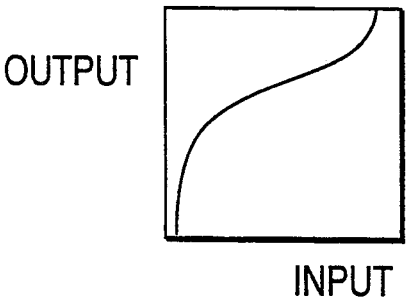

When the video signal level - screen brightness characteristics measured against the certain two kinds of temperature levels are those as shown in (1) and (2) in FIG. 21 (*a*), the inverse curves of the respective characteristic curves are computed to prepare the correction data in FIG. 21 (*b*) on the characteristic (1) and in FIG. 21 (*c*) on the characteristic (2). In this paragraph, a description has been provided for a certain color, but the situation is the same as to other two colors.

Furthermore, as the variation $\Delta V_T$ of the threshold voltage which is a rising position of the video signal level - screen brightness characteristic is in the relationship of $\Delta V_T \sim EXP(-a/T)$ to the temperature T(K) of the liquid crystal panel, the temperature is set by each case of the showing of the certain threshold voltage variation, and the table number for said temperature level is stored in the temperature distribution position memory 202*a*. And also, in order to prepare the correction data to be stored in the look-up-table memory 201, measurement of the video signal level - screen brightness characteristic at the said temperature level is carried out.

Accordingly, according to this embodiment, when there is variation in the video signal level - screen brightness characteristic due to a temperature change in the liquid crystal panel, the table for said variation can be arbitrarily selected, and by converting the video signal in reference to said table, there can be obtained an effect which makes it possible to perform an effective linearity compensation.

Figure 22:
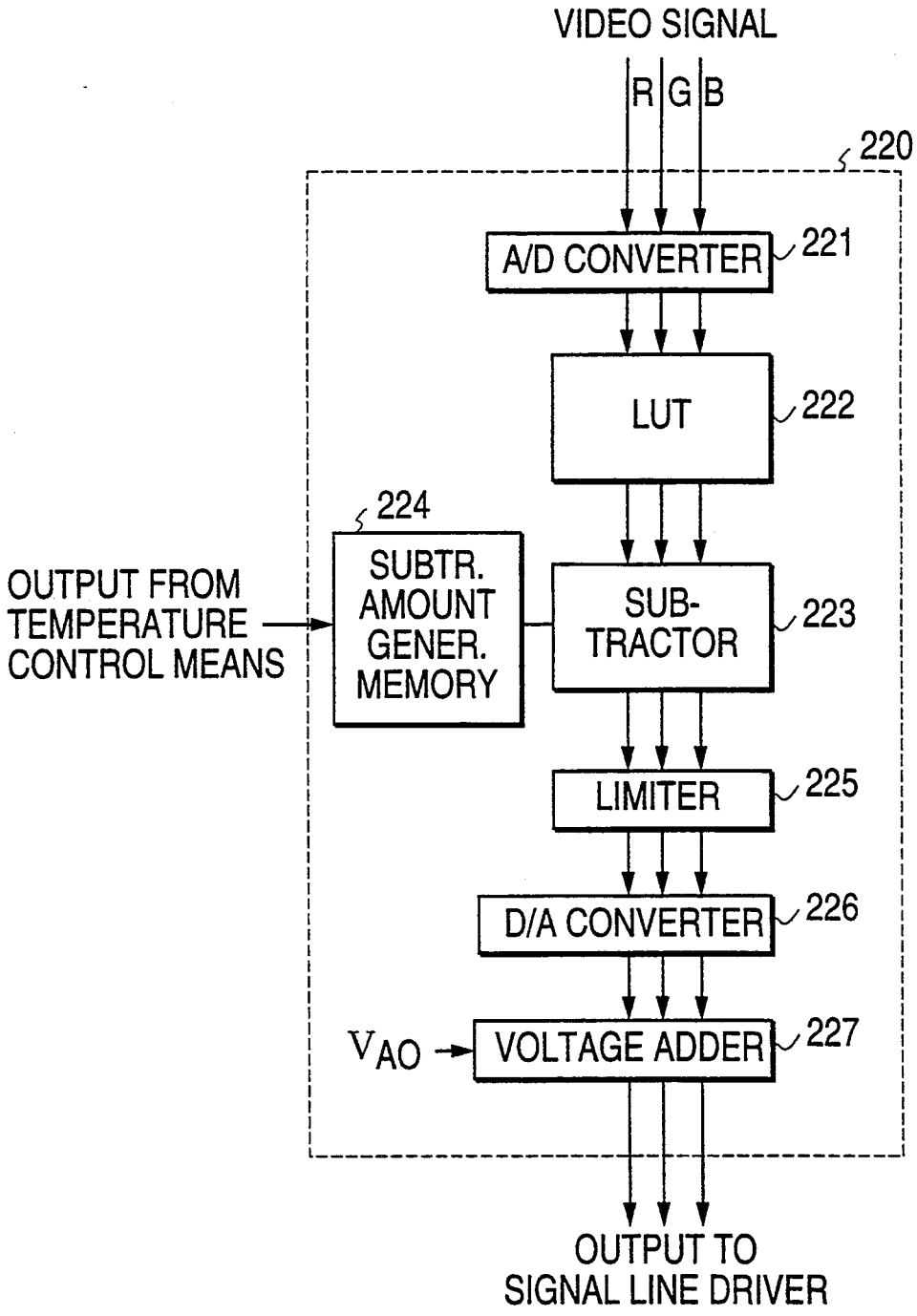
FIG. 22 is a view showing the construction of the correction processing means in the example of changing the correction processing means in the second embodiment.

The correction processing means can be of the following construction:

FIG. 22 shows a construction of the correction processing means 220, in which the video input signals (e.g., the three basic colors R, G and B) are converted to digital signals (e.g., data of 8 bits per color) by the A/D converter 227 and are inputted to the address of the look-up-table memory 222, and are subjected to correction by referring to the table. In the look-up-table memory 222, the bit width of the output data is larger than the bit width of the input data (e.g., the output data having 9 bit width). Of the corrected video signal, the value corresponding to the temperature variation of the liquid crystal panel is subtracted by the subtractor 223, after which, in order to obtain agreement with the bit width of the input data of the look-up-table memory 222, it is subjected to limitation of the maximum value and the minimum value with the limiter 225 and converted to an analog signal by the D/A converter 226. Furthermore, after addition of an offset voltage $V_{AO}$ which is in agreement with the threshold voltage which shows the rising position of the video signal level - screen brightness characteristic by the voltage adder 227, the video signals are inputted to the signal line driver. Furthermore, at this time, by referring to the subtraction amount generation memory 224 storing the data for correlating the output data from the temperature control means with the subtraction amount in the subtractor, the subtraction amount of said output is subtracted from the output data of the look-up-table memory 222.

The operation of the correction processing means constituted as above is shown below.

Figure 23A:
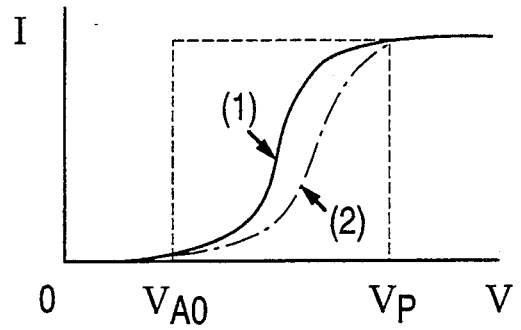
FIG. 23(*a*)–23(*e*) are views showing the operation of the compensation and conversion thereof.
Figure 23B:
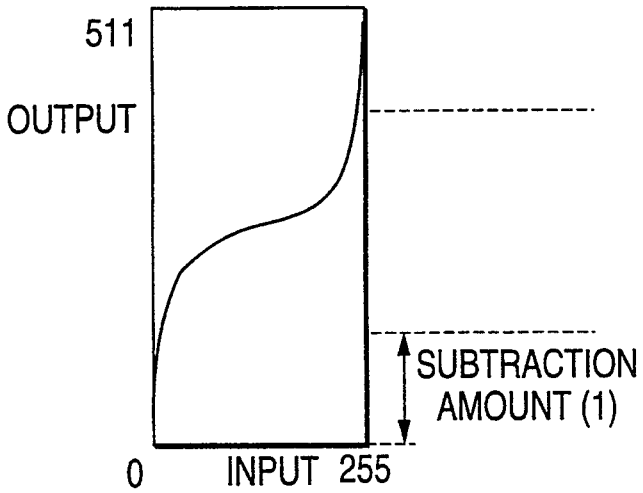
Figure 23C:
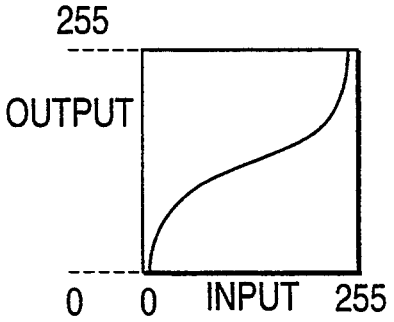
Figure 23D:
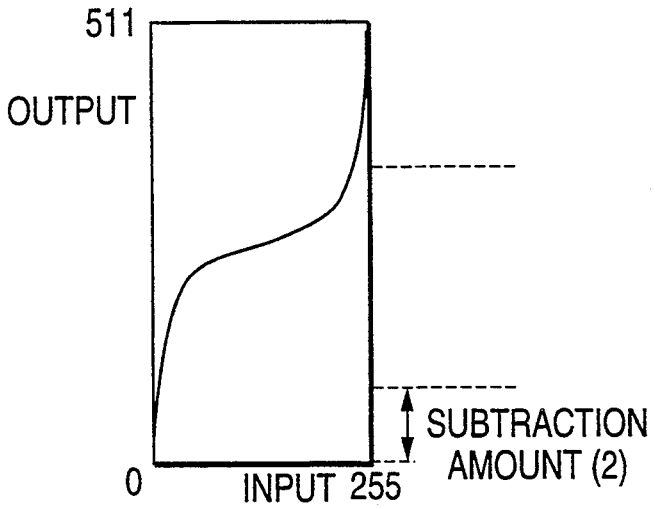
Figure 23E:
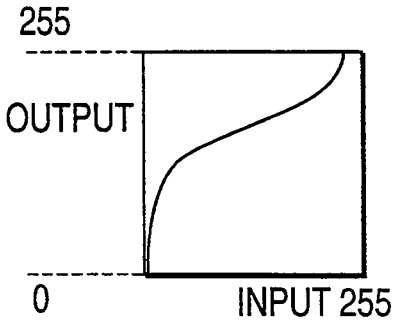

When the video signal level - screen brightness characteristic measured with respect to a certain temperature level is of a characteristic as shown by (1) in FIG. 23 (*a*), an inverse curve of the characteristic curve is computed to prepare correction data as shown in FIG. 23 (b) [FIG. 23(d) being the same] (e.g., input data having 8 bit width and output data having 9 bit width). When the video input signal level to the liquid crystal panel is set to a range from $V_{AO}$ to $V_P$, the video signal sustains a conversion as shown by the dotted line. Accordingly, for the purpose of this conversion, the subtraction amount (1) as shown between FIG. 23(*b*) and FIG. 23(*c*) in FIG. 23 is subtracted from the output data of the look-up-table memory 222 with the subtractor 223, after which data value amounts which are smaller than "0" data value amounts which are limited to "0", and larger than "255" to "255" are limited, so as to bring them within the range of "0 −255". As a result, the correction characteristic of the apparatus combined with the look-up-table memory 222, subtractor 223, and limiter 225 indicates the characteristic as shown in FIG. 23 (*c*). Furthermore, when the temperature level of the liquid crystal panel has varied and the video signal level - screen brightness characteristic has become the characteristic as shown by (2) in FIG. 23 (*a*), the subtraction amount (2) corresponding to the said temperature level [shown between FIG. 23(*d*) and FIG. 23(*e*) in FIG. 23] is subtracted from the output data of the look-up-table memory 222 in which the correction data as shown in FIG. 23 (*d*) is stored. As a result, the correction characteristic of the apparatus combined with the look-up-table memory, subtractor, and limiter becomes that as shown in FIG. 23 (*e*). In this paragraph an explanation has been provided for a certain color, but the relationships are the same with respect to the other two colors.

Accordingly, by constituting as in the abovementioned correction processing means, when a exists in the video signal level - screen brightness characteristic due to the temperature variation of the liquid crystal panel, the subtraction amount for the variation can be arbitrarily Selected and subtracted from the compensation conversion output in the look-up-table memory, so that an effect can be obtained which makes it possible to perform an effective linearity correction by only doubling in the capacity of the look-up-table memory.

In the above paragraphs, concrete correction processing means and temperature control means have been described for the purpose of explaining the present invention. However, it is to be understood that the present invention is not limited to the specific means. It is to be noted that all such changes apparent to those skilled in the art are included in the scope of the present invention.

Figure 24:
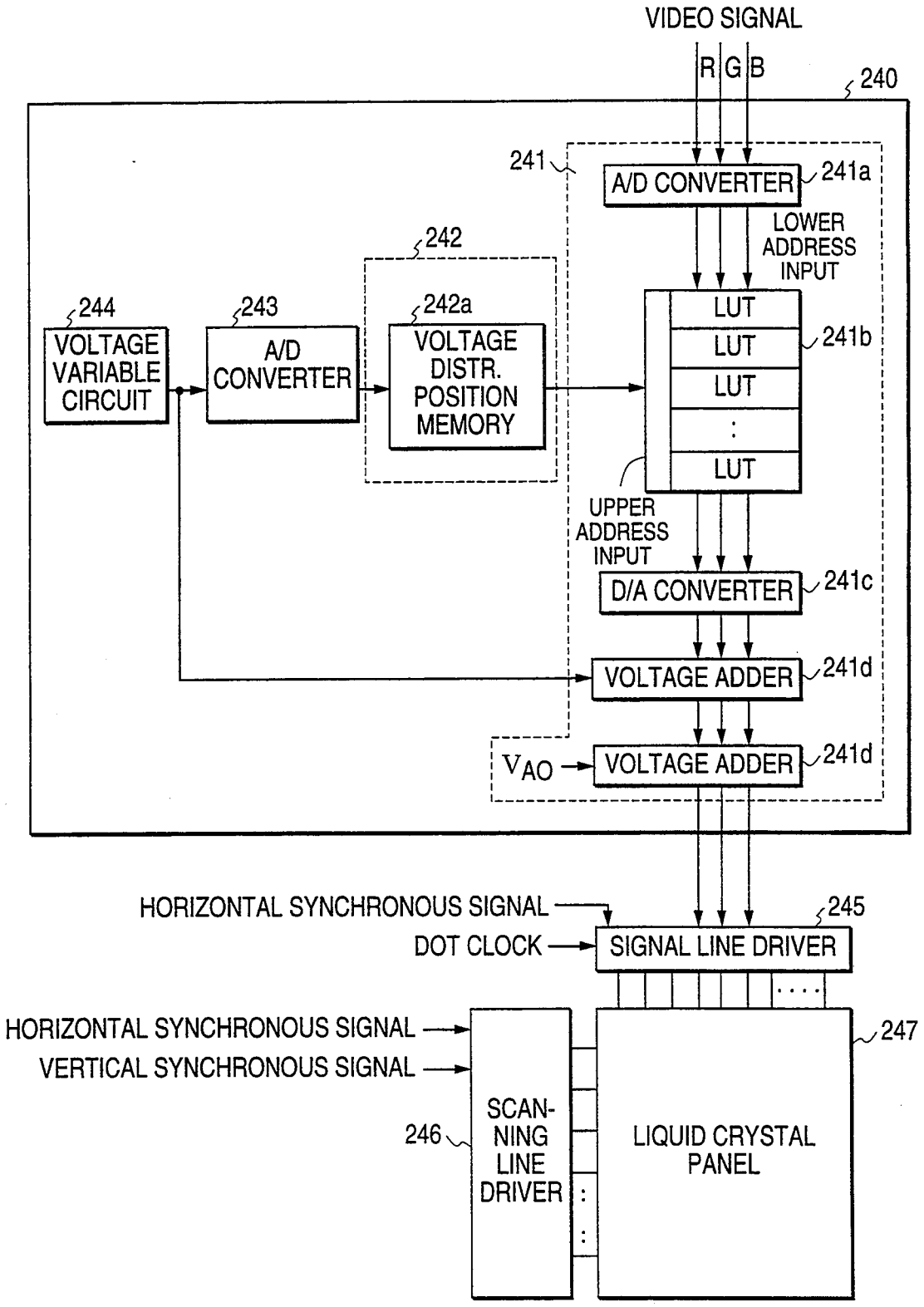
FIG. 24 is a view showing the construction of the liquid crystal display device using the video signal compensation apparatus in accordance with the third embodiment of the present invention.

FIG. 24 shows a construction of the liquid crystal display device using the video signal compensation apparatus in accordance with the third embodiment of the present invention. In FIG. 24, the numeral 240 denotes a video signal compensation apparatus, element 241 is a correction processing means, element 241*a* is an A/D converter, element 241*ba* is look-up-table memory; element 241*c* is a D/A converter, element 241*d* and 241*e* are voltage adders; element 242 is an offset voltage control means, element 242*a* is a voltage distribution position memory, element 243 is an A/D converter, and element 244 is a voltage variable circuit.

The video input signals (e.g., three basic color signals of R, G and B) are converted into digital signals by the A/D converter 241*a*, and are then inputted to the address (e.g., lower address) of the look-up-table memory 241*b* and subjected to correction by referring to the table. The corrected video signals are converted to the analog signals by a D/A converter 247*c*, and are then added to the offset voltage by the voltage adder element 241*d*; by being added to the offset voltage $V_{AO}$ which is in agreement with the threshold voltage which shows the rising position of the video signal level - screen brightness characteristic by the voltage adder 241*e*, the screen brightness level at the time when the video signal level is low increases. This offset voltage is generated by the voltage variable circuit 244. Thereafter, by inputting to the signal line driver 245, they drive the liquid crystal panel 247 for every selected line by the scanning line driver 246. Also, the table number of the output of the voltage data obtained by converting the offset voltage generated in the voltage variable circuit 244 into a digital signal by the A/D converter 243 is inputted to the address (e.g., the upper address) of the look-up-table memory 241*b* as its table number output after referring to the voltage distribution position memory 242*a*. By storing the data correlation between the voltage level with the table number corresponding to the voltage distribution position in the voltage distribution memory 242*a*, the look-up-table can be addressed with respect to the offset voltage level.

Hereinafter, the operation of the video signal compensation apparatus constituted as above is explained.

Figure 25A:
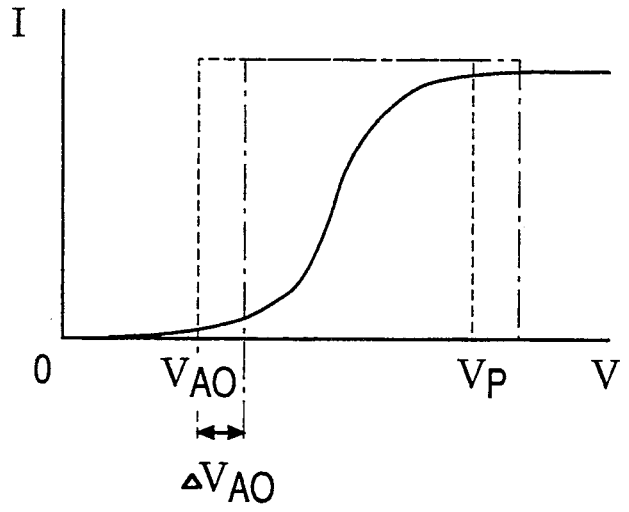
FIG. 25(*a*)–25(*c*) are views showing the operation of the compensation and conversion in the third embodiment.
Figure 25B:
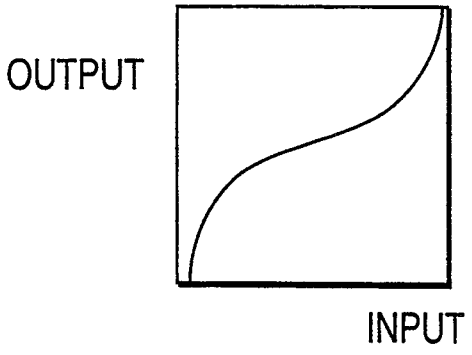
Figure 25C:
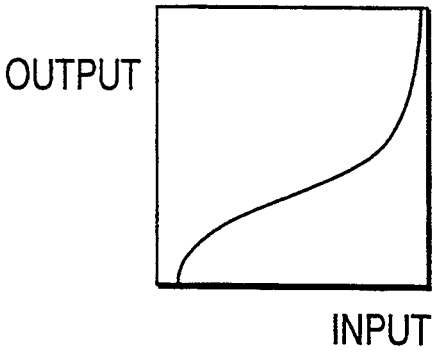

When the video signal level - screen brightness characteristic measured with respect to a certain temperature level is of a characteristic as shown in FIG. 25 (*a*), if the offset voltage is only $V_{AO}$, an inverse curve of the characteristic curve of the position surrounded by the dashed line is computed to prepare a correction data as shown in FIG. 25 (*b*), and when the voltage $\Delta V_{AO}$ generated in the voltage variable circuit is added to the offset voltage, an inverse curve of the characteristic curve of the portion surrounded by an alternate dot and chain line is computed to prepare a correction data as shown in FIG. 25 (*c*). In this paragraph explanation has been provided for a certain color, but the relationships are the same with respect to the other two colors.

Furthermore, the table number for the offset voltage $\Delta V_{AO}$ generated in the voltage variable circuit is stored in the table selection memory.

Accordingly, according to this embodiment, when there exists the variation of the video signal level - screen brightness characteristic, by increasing the screen brightness level at the time of the low video signal level by changing the offset voltage, the table number for said variation can be arbitrarily selected, so that there can be obtained an effect which makes it possible to perform an effective linearity correction by the compensation conversion in reference to said table.

In the above paragraphs, concrete correction processing means and offset voltage control means have been described for the purpose of explaining the present invention. However, it is to be understood that the present invention is not limited to the specific means. It is to be noted that all such changes apparent to those skilled in the art are included in the scope of the present invention.

Figure 26:
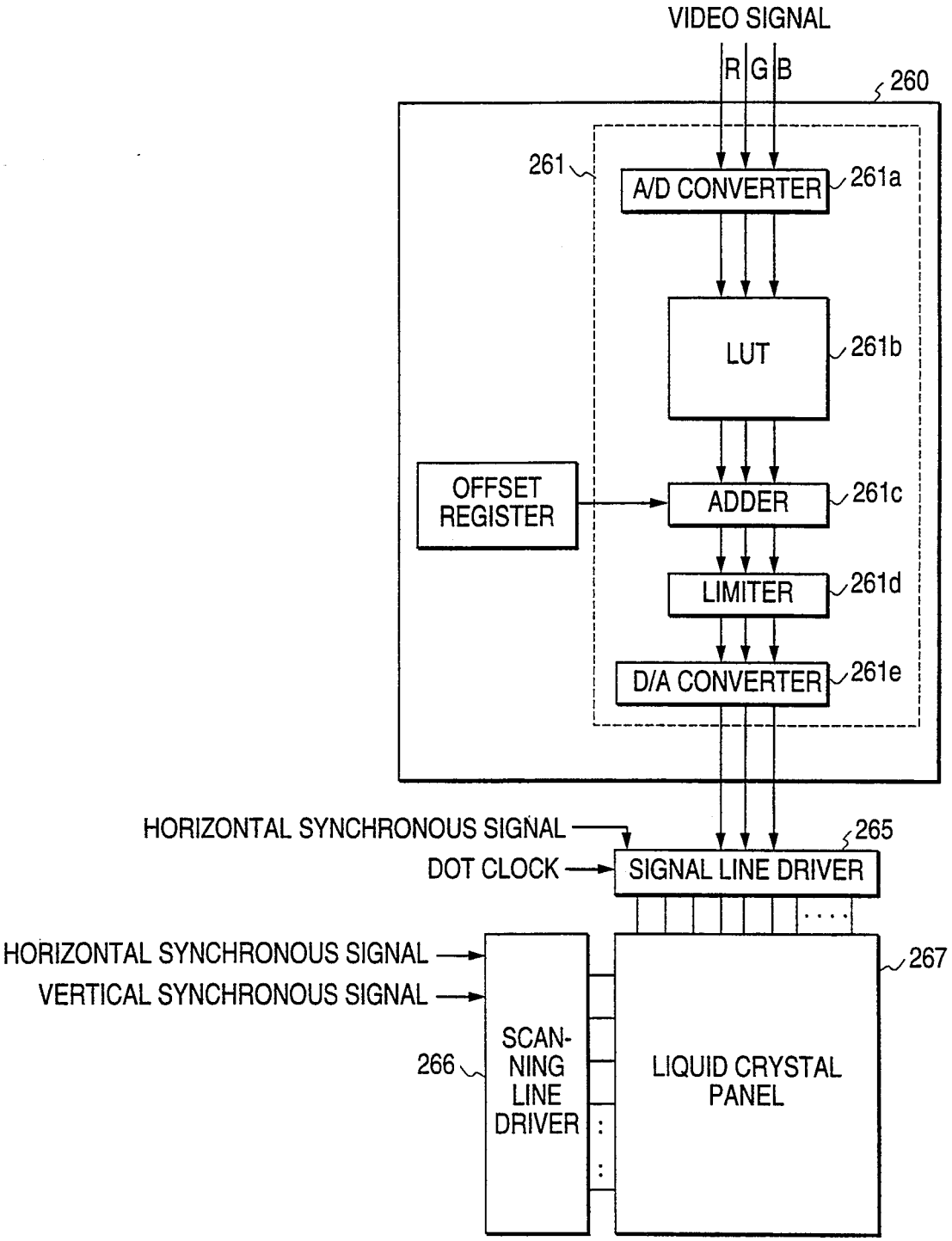
FIG. 26 is a view showing the construction of the liquid crystal display device using the video signal compensation apparatus in accordance with the fourth embodiment of the present invention.

FIG. 26 shows a construction of the liquid crystal display device using the video signal compensation apparatus in accordance with the fourth embodiment of the present invention. In FIG. 26, the numeral 260 denotes a video signal compensation apparatus, element 261 is a correction processing means, element 261*a* is an A/D converter; element 261*b* is a lock-up-table memory; element 261*c* is an adder; element 261*d* is a limiter; element 261*e* is a D/A converter, and element 262 is an offset register.

The video input signals (e.g., three basic color signals of R, G and B) are converted into the digital signals by the A/D converter 261*a*, and are then inputted to the address of the look-up-table memory 261*b* and subjected to correction by referring to the table. The corrected video signals are added to the addition value stored in the offset register 262 by the adder 261*c*, and then subjected to the maximum value limitation in the limiter 261*d*, and then converted to analog signals by the D/A converter 261*e*. By inputting to the signal line driver 265, they drive the liquid crystal panel 267 for every selected line by the scanning line driver 266.

Hereinafter, the operation of the video signal compensation apparatus constituted as above is explained.

Figure 27A:
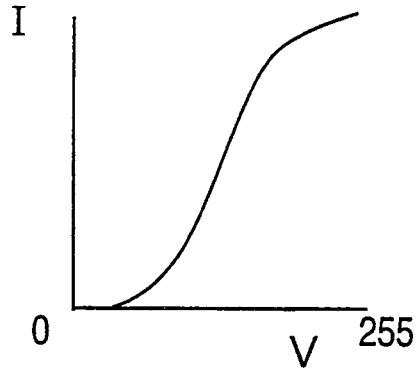
FIG. 27(*a*)–27(*c*) are views showing the operation of the compensation and conversion in the fourth embodiment.
Figure 27B:
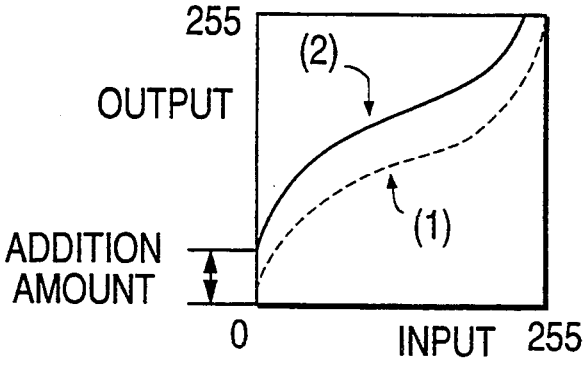
Figure 27C:
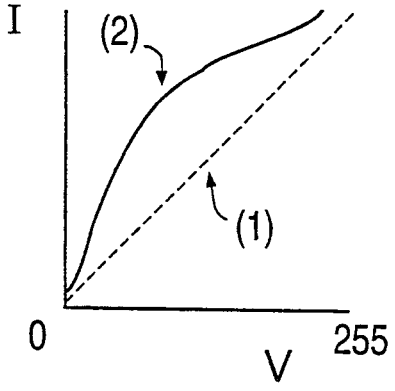

When the measured video signal level - screen brightness characteristic is the characteristics as shown in FIG. 27 (*a*), the inverse curve of the characteristic curve is computed to prepare the correction data as shown in FIG. 27 (*b*) (e.g., input and output data having 8 bit width). To the corrected video signal, the addition value which is set on the offset register 262 as shown in FIG. 27 (*b*) is added by an adder 261*c*, and the resulting data value which is higher than "255" is limited to "255" by the limiter circuit 261*d*. By this, the total characteristics of the look-up-table memory 261*b*, the adder 261*c* and the limiter 261*d* becomes as shown in (2) in FIG. 27 (*b*). When the liquid crystal panel is driven by the video signal which has been subjected to the conversion of the characteristic, the said video signal level - screen brightness characteristic becomes as shown in (2) in FIG. 27 (*c*), in which case, in comparison with the video signal level - screen brightness characteristic (1) in FIG. 27 (c) in the case where the conversion of the look-up-table memory only has been obtained, deterioration of contrast at the half-time level of the video signal can be prevented. In this paragraph an explanation has been provided only for a single color, but the relationship are the same with respect to the other two colors.

Accordingly, according to this embodiment, it is possible to prevent deterioration of contrast at the half-time level of the video signal, and to obtain an effect which makes it possible to carry out linearity correction suited to the liquid crystal display.

The correction processing means can be of the construction as shown below.

Figure 28:
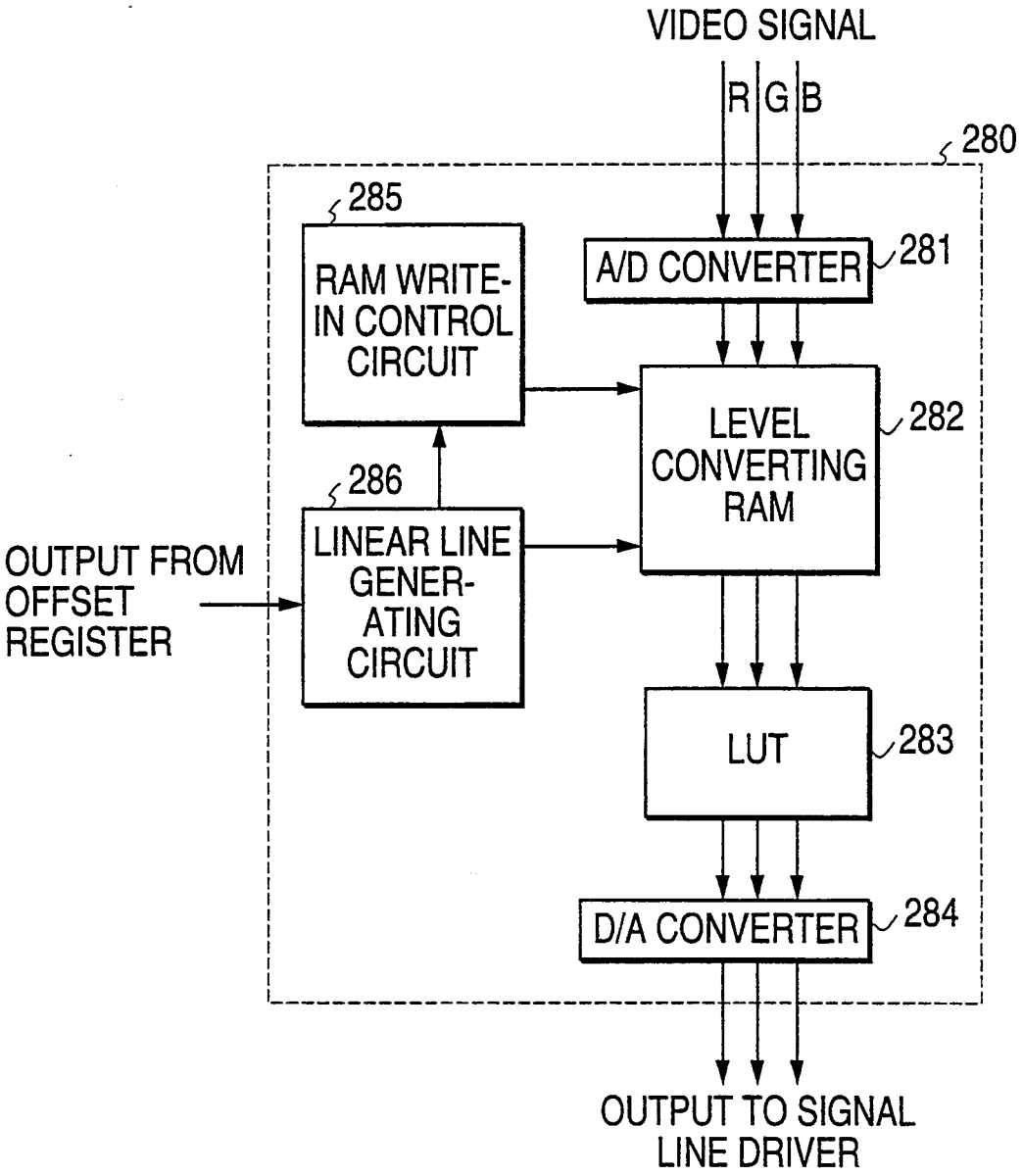
FIG. 28 is a view showing the construction of the correction processing means in the example of changing the correction processing means in the fourth embodiment.
Figure 29A:
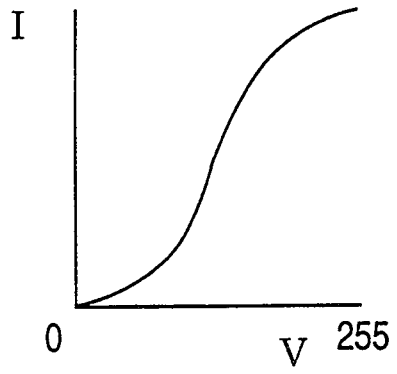
FIG. 29(*a*)–29(*d*) are views showing the operation of the compensation conversion thereof.
Figure 29B:
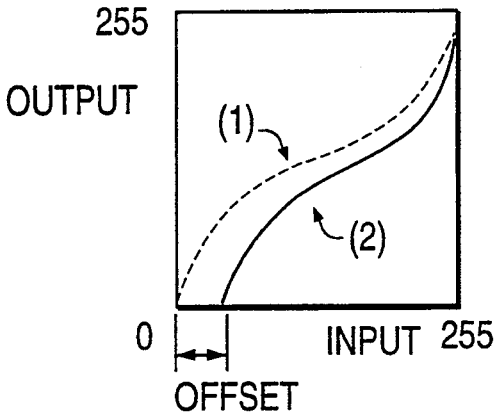
Figure 29C:
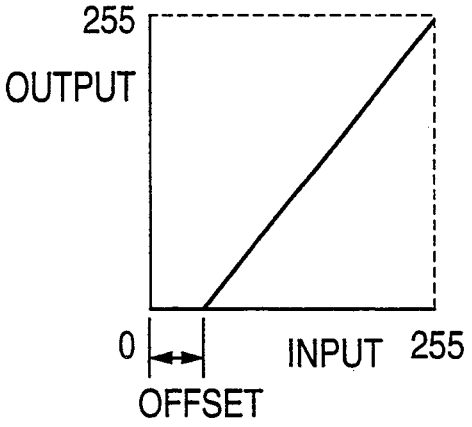
Figure 29D:
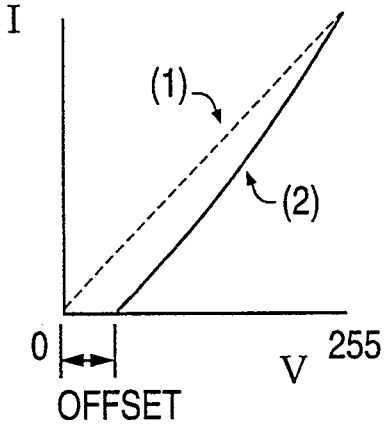

FIG. 28 shows a construction of the correction processing means 280, in which the video input signals (e.g. , three basic color signals of R, G and B) are converted into the digital signals by an A/D converter 281, and are then first subjected to level conversion by referring to the level conversion RAM 282. In the level conversion RAM 282, the conversion data computed in the linear line generating circuit (for example DDA circuit) 286 from the offset value which is an output from the offset register are written by the generation of the writing control signal to the level conversion RAM by the RAM write-in control circuit 285 on receipt of the computation completion signal thereof. The video signal data converted by the level conversion RAM 282 is inputted to the address of the look-up-table memory 283, and corrected by referring to the table. The corrected video signal is converted to an analog signal by the D/A converter 284 and inputted to the signal line driver 35.

The operation of the correction processing means constituted as above is shown below.

When the measured video signal level - screen brightness characteristic is the characteristic as shown in FIG. 29 (*a*), an inverse curve of the characteristic curve is computed to prepare a correction data as shown in (1) in FIG. 29 (*b*) (e.g., input and output data having 8 bit width). Furthermore, the conversion data to be stored in the level conversion RAM 282 for the purpose of the level conversion of the video signal is the linear data as shown in FIG. 29 (*c*) computed by DDA procedure from the offset value as shown in FIG. 29 (*b*) as an output from the offset register. As a result, the total characteristic of the level conversion RAM 282 and look-up-table memory 283 becomes the characteristic as shown in (2) in FIG. 29 (*b*). When the liquid crystal panel is driven by the video signal which has been subjected to the conversion of characteristic, the video signal level - screen brightness characteristic thereof becomes the characteristic as shown in (2) in FIG. 29 (*d*), so that, in comparison with the video signal level - screen brightness characteristic [(1) in FIG. 29 (*d*)] of the case where it has been subjected to the conversion of the look-up-table memory only, fogging of the black level of the video signal can be prevented. In this paragraph, an explanation has been provided only for a single color, but the relationships are the same with respect to the other two colors.

Accordingly, when the system is constituted as in the abovementioned correction processing means, it is possible to prevent fogging of the black level of the video signal, and an effect which makes it possible to carry out linearity correction suited to the liquid crystal display can be obtained.

In the above paragraphs, concrete correction processing means have been described for the purpose of explaining the present invention. However, it is to be understood that the present invention is not limited to the specific correction processing means. It is to be noted that all such changes apparent to those skilled in the art are included in the scope of the present invention.

Furthermore, for the purpose of explaining the present invention, concrete embodiments have been described. However, it is apparent that the present invention is not limited to these embodiments but is effective as a video signal compensation apparatus for the dot matrix displays such as EL display or plasma display. It is to be noted that all such modifications apparent to those skilled in the art are to be included in the scope of the present invention.

What is claimed is:

1. A display apparatus comprising a dot matrix type display apparatus for displaying a video signal on a pixel by pixel basis by a dot clock and horizontal and vertical synchronous signals, and a video signal compensation apparatus for compensating the video signal, wherein said video signal compensation apparatus comprises:

a dot counter for counting the dot clock and outputting a first count signal indicative of a horizontal screen position;

a line counter for counting said the horizontal synchronous signal and outputting a second count signal indicative of a vertical screen position;

a screen split control means for producing an output signal according to said first and second count signals which is indicative of a screen split region, said split screen region being one of a plurality of screen split regions; and a correction processing means for correcting an input video signal according to said output signal from said screen split control means and for outputting a corrected video signal to said dot matrix type display apparatus;

and wherein said correction processing means comprises:

an analog-to-digital converter for converting the input video signal to a digital signal;

a look-up-table memory means including therein a plurality of tables each of which has stored therein correction data for a corresponding one of said plurality of screen split regions, said look-up-table memory means being responsive to said output signal from said screen split control means for selecting one of said plurality of tables corresponding to a screen split region indicated by said signal outputted from said screen split control means and for correcting said digital signal from said analog-to-digital converter according to the correction data stored in the selected one of said plurality of tables; and a digital-to-analog converter for converting a corrected digital signal outputted from said look-up-table memory means to an analog signal, said analog signal from said digital-to-analog converter being outputted as said corrected video signal from said correction processing means;

wherein the correction data stored in each look-up-table is data prepared by measuring a video signal level versus screen brightness characteristic curve of the dot matrix display apparatus for each of three primary colors in a corresponding one of the plurality of screen split regions and computing an inverse conversion curve to said characteristic curve;

and wherein said screen split control means comprises a horizontal split bit selection circuit connected to said dot counter for selecting from bits of said first count signal a bit which is renewed by every horizontal split position and bits which are higher order than said bit, and a vertical split bit selection circuit connected to said line counter for selecting from bits of said second count signal a bit which is renewed by every vertical split position and bits which are higher order bits than said bit, the selected bits of said first and second cut signals being outputted as said signal indicative of a screen split region.

2. A display apparatus comprising a dot matrix type display apparatus for displaying a video signal on a pixel by pixel basis by a dot clock and horizontal and vertical synchronous signals, and a video signal compensation apparatus for compensating the video signal, wherein said video signal compensation apparatus comprises:

a dot counter for counting the dot clock and outputting a first count signal indicative of a horizontal screen position;

a line counter for counting said the horizontal synchronous signal and outputting a second count signal indicative of a vertical screen position;

a screen split control means for producing an output signal according to said first and second count signals which is indicative of a screen split region, said split screen region being one of a plurality of screen split regions; and a correction processing means for correcting an input video signal according to said output signal from said screen split control means and for outputting a corrected video signal to said dot matrix type display apparatus;

and wherein said correction processing means comprises:

an analog-to-digital converter for converting the input video signal to a digital signal;

a look-up-table memory means including therein a plurality of tables each of which has stored therein correction data for a corresponding one of said plurality of screen split regions, said look-up-table memory means being responsive to said output signal from said screen split control means for selecting one of said plurality of tables corresponding to a screen split region indicated by said signal outputted from said screen split control means and for correcting said digital signal from said analog-to-digital converter according to the correction data stored in the selected one of said plurality of tables; and a digital-to-analog converter for converting a corrected digital signal outputted from said look-up-table memory means to an analog signal, said analog signal from said digital-to-analog converter being outputted as said corrected video signal from said correction processing means;

wherein the correction data stored in each look-up-table is data prepared by measuring a video signal level versus screen brightness characteristic curve of the dot matrix display apparatus for each of three primary colors in a corresponding one of the plurality of screen split regions, computing a minimum level among maximum screen brightness levels in said plurality of screen split regions.

3. A display apparatus according to claim 2, wherein said screen split control means comprises a horizontal split bit selection circuit connected to said dot counter for selecting from bits of said first count signal a bit which is renewed by every horizontal split position and bits which are higher order than said bit, and a vertical split bit selection circuit connected to said line counter for selecting from bits of said second count signal a bit which is renewed by every vertical split position and bits which are higher order bits than said bit, the selected bits of said first and second cut signals being outputted as said signal indicative of a screen split region.

4. A display apparatus according to claim 2, wherein said screen split control means comprises a horizontal split position memory connected to said dot counter for generating from said first count signal a signal which is indicative of a horizontal screen split position, and a vertical split position memory connected to said line counter for generating from said second count signal a signal which is indicative of a vertical screen split position, said signals generated by said horizontal split position memory and said vertical split position memory being outputted as said signal indicative of a screen split region.

5. A display apparatus according to claim 2, wherein said screen split control means comprises a horizontal split position memory connected to said dot counter for generating from said first count signal a signal which is indicative of a horizontal screen split position, a vertical split position memory connected to said line counter for generating from said second count signal a signal which is indicative of a vertical screen split position, and a block address memory connected to said horizontal split position memory and said vertical split position memory for generating said signal indicative of a screen split region from said signals generated by said horizontal split position memory and said vertical split position memory.

6. A display apparatus comprising a dot matrix type display apparatus for displaying a video signal on a pixel by pixel basis by a dot clock and horizontal and vertical synchronous signals, and a video signal compensation apparatus for compensating the video signal, wherein said video signal compensation apparatus comprises:

a dot counter for counting the dot clock and outputting a first count signal indicative of a horizontal screen position;

a line counter for counting said the horizontal synchronous signal and outputting a second count signal indicative of a vertical screen position;

a screen split control means for producing an output signal according to said first and second count signals which is indicative of a screen split region, said split screen region being one of a plurality of screen split regions; and a correction processing means for correcting an input video signal according to said output signal from said screen split control means and for outputting a corrected video signal to said dot matrix type display apparatus;

and wherein said correction processing means comprises:

an analog-to-digital converter for converting the input video signal to a digital signal;

a look-up-table memory means including therein a plurality of tables each of which has stored therein correction data for a corresponding one of said plurality of screen split regions, said look-up-table memory means being responsive to said output signal from said screen split control means for selecting one of said plurality of tables corresponding to a screen split region indicated by said signal outputted from said screen split control means and for correcting said digital signal from said analog-to-digital converter according to the correction data stored in the selected one of said plurality of tables; and a digital-to-analog converter for converting a corrected digital signal outputted from said look-up-table memory means to an analog signal, said analog signal from said digital-to-analog converter being outputted as said corrected video signal from said correction processing means;

wherein the correction data stored in each look-up-table is data prepared by measuring a video signal level versus screen brightness characteristic curve of the dot matrix display apparatus for each of three primary colors in a corresponding one of the plurality of screen split regions, computing a normalization level at which mixture of three primary colors of maximum screen brightness levels in the corresponding screen split region becomes white color, and computing an inverse conversion curve to a part of said characteristic curve from zero level to said normalization level.

7. A display apparatus according to claim 6, wherein said screen split control means comprises a horizontal split bit selection circuit connected to said dot counter for selecting from bits of said first count signal a bit which is renewed by every horizontal split position and bits which are higher order than said bit, and a vertical split bit selection circuit connected to said line counter for selecting from bits of said second count signal a bit which is renewed by every vertical split position and bits which are higher order bits than said bit, the selected bits of said first and second cut signals being outputted as said signal indicative of a screen split region.

8. A display apparatus according to claim 6, wherein said screen split control means comprises a horizontal split position memory connected to said dot counter for generating from said first count signal a signal which is indicative of a horizontal screen split position, and a vertical split position memory connected to said line counter for generating from said second count signal a signal which is indicative of a vertical screen split position, said signals generated by said horizontal split position memory and said vertical split position memory being outputted as said signal indicative of a screen split region.

9. A display apparatus according to claim 6, wherein said screen split control means comprises a horizontal split position memory connected to said dot counter for generating from said first count signal a signal which is indicative of a horizontal screen split position, a vertical split position memory connected to said line counter for generating from said second count signal a signal which is indicative of a vertical screen split position, and a block address memory connected to said horizontal split position memory and said vertical split position memory for generating said signal indicative of a screen split region from said signals generated by said horizontal split position memory and said vertical split position memory.

* * * * *